US010614950B2

(12) United States Patent
Ahn et al.

(10) Patent No.: US 10,614,950 B2
(45) Date of Patent: Apr. 7, 2020

(54) COIL COMPONENT ASSEMBLY FOR MASS PRODUCTION OF COIL COMPONENTS AND COIL COMPONENTS MADE FROM COIL COMPONENT ASSEMBLY

(71) Applicant: SAMSUNG ELECTRO-MECHANICS CO., LTD., Suwon-Si, Gyeonggi-Do (KR)

(72) Inventors: Jin Mo Ahn, Suwon-Si (KR); Yun Suk Oh, Suwon-Si (KR); Jae Yeol Choi, Suwon-Si (KR)

(73) Assignee: Samsung Electro-Mechanics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/000,298

(22) Filed: Jun. 5, 2018

(65) Prior Publication Data

US 2018/0286569 A1 Oct. 4, 2018

Related U.S. Application Data

(62) Division of application No. 14/926,953, filed on Oct. 29, 2015, now Pat. No. 10,049,808.

(30) Foreign Application Priority Data

Oct. 31, 2014 (KR) ..... 10-2014-0150755
Sep. 10, 2015 (KR) ..... 10-2015-0128073

(51) Int. Cl.
*H01F 27/29* (2006.01)
*H01F 27/28* (2006.01)
(Continued)

(52) U.S. Cl.
CPC ..... *H01F 27/29* (2013.01); *H01F 17/04* (2013.01); *H01F 27/2823* (2013.01);
(Continued)

(58) Field of Classification Search
CPC ..... H01F 27/2804; H01F 27/29
See application file for complete search history.

(56) References Cited

U.S. PATENT DOCUMENTS 7,786,835 B2 8/2010 Kawarai
8,975,997 B2 3/2015 Tonoyama et al.
(Continued)

FOREIGN PATENT DOCUMENTS

CN 1108799 A 9/1995
CN 1996518 A 7/2007
(Continued)

OTHER PUBLICATIONS

Korean Office Action issued in related Korean Patent Application No. 10-2016-0003166, dated Feb. 2, 2016, with English Translation.
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component assembly includes a support member, a plurality of processed spaces penetrating through the support member, a plurality of coils disposed in the plurality of processed spaces, respectively, and a magnetic material covering the support member and the plurality of coils. The coil component assembly can be diced to form individually coil components.

19 Claims, 32 Drawing Sheets

(51) Int. Cl.
*H01F 17/04* (2006.01)
*H01F 27/30* (2006.01)

(52) U.S. Cl.
CPC ..... *H01F 27/306* (2013.01); *H01F 27/2828* (2013.01); *H01F 2017/048* (2013.01)

(56) References Cited

U.S. PATENT DOCUMENTS

| | | | | |
|---|---|---|---|---|
| 2006/0186979 | A1* | 8/2006 | Kawarai | H01F 17/043 336/83 |
| 2007/0030107 | A1* | 2/2007 | Waffenschmidt | H01F 27/2804 336/200 |
| 2007/0146108 | A1 | 6/2007 | Hwang et al. | |
| 2010/0259353 | A1* | 10/2010 | Saito | H01F 27/292 336/205 |
| 2012/0188046 | A1 | 7/2012 | Matsuura et al. | |
| 2013/0033347 | A1* | 2/2013 | Matsuura | H01F 17/0013 336/83 |
| 2013/0222101 | A1* | 8/2013 | Ito | H01F 17/04 336/83 |
| 2013/0249662 | A1* | 9/2013 | Tonoyama | H01F 27/255 336/200 |
| 2013/0249664 | A1 | 9/2013 | Tonoyama et al. | |
| 2013/0255071 | A1* | 10/2013 | Muneuchi | H01F 41/02 29/605 |
| 2013/0307655 | A1* | 11/2013 | Saito | H01F 17/043 336/83 |
| 2013/0341758 | A1 | 12/2013 | Lee et al. | |
| 2014/0145814 | A1* | 5/2014 | Lee | H01F 17/0013 336/200 |
| 2014/0145816 | A1 | 5/2014 | Sato et al. | |
| 2015/0028985 | A1* | 1/2015 | Inubushi | H01F 27/306 336/196 |
| 2015/0248963 | A1* | 9/2015 | Inaba | H01F 1/26 363/131 |
| 2016/0268036 | A1* | 9/2016 | Nakamura | H01F 27/2823 |

FOREIGN PATENT DOCUMENTS

| | | | | |
|---|---|---|---|---|
| CN | 102460613 | A | 5/2012 | |
| CN | 102682951 | A | 9/2012 | |
| CN | 202887902 | U | 4/2013 | |
| CN | 103180919 | A | 6/2013 | |
| CN | 103295754 | A | 9/2013 | |
| CN | 103366919 | A | 10/2013 | |
| CN | 103366947 | A | 10/2013 | |
| CN | 103871724 | A | 6/2014 | |
| CN | 203799822 | U | 8/2014 | |
| JP | 55-96621 | A | 7/1980 | |
| JP | 11-150035 | A | 6/1999 | |
| JP | H11-288818 | A | 10/1999 | |
| JP | 2001-126927 | A | 5/2001 | |
| JP | 2004-200373 | A | 7/2004 | |
| JP | 2007305665 | A * | 11/2007 | H01F 30/00 |
| JP | 2010-021506 | A | 1/2010 | |
| JP | 2010-186909 | A | 8/2010 | |
| JP | 2011-003761 | A | 1/2011 | |
| JP | 2013-110184 | A | 6/2013 | |
| KR | 10-2005-0056863 | A | 6/2005 | |
| KR | 10-0809565 | B1 | 3/2008 | |
| KR | 10-2010-0048249 | A | 5/2010 | |
| KR | 10-2010-0094271 | A | 8/2010 | |
| KR | 10-2010-0129025 | A | 12/2010 | |
| KR | 10-2012-0084657 | A | 7/2012 | |
| KR | 10-1194785 | B1 | 10/2012 | |
| KR | 10-2013-0016033 | A | 2/2013 | |
| KR | 10-2013-0100717 | A | 9/2013 | |
| KR | 20130100717 | A * | 9/2013 | H01F 27/255 |
| KR | 20130100717 | A * | 9/2013 | H01F 41/02 |
| KR | 10-2013-0109048 | A | 10/2013 | |
| KR | 10-2013-0126723 | A | 11/2013 | |
| KR | 10-2013-0134639 | A | 12/2013 | |
| KR | 10-2014-0038780 | A | 3/2014 | |
| KR | 10-2014-0038781 | A | 3/2014 | |
| KR | 10-2014-0066438 | A | 6/2014 | |
| KR | 10-1430427 | B1 | 8/2014 | |
| WO | 95/17072 | A1 | 6/1995 | |
| WO | 2010129230 | A1 | 11/2010 | |

OTHER PUBLICATIONS

Japan Office Action issued in related Japanese Patent Application No. 2015-215876, dated Sep. 27, 2016, with English Translation.
Chinese Office Action issued in related Chinese Patent Application No. 201510726349.8, dated Jan. 26, 2017, with English Translation.
Korean Office Action issued in related Korean Patent Application No. 10-2016-0006116, dated Apr. 21, 2017, with English Translation.
Korean Office Action issued in related Korean Patent Application No. 10-2015-0156135, dated Apr. 19, 2017, with English Translation.
Non-Final Office Action issued in parent U.S. Appl. No. 14/926,953, dated Jan. 27, 2017.
Final Office Action issued in parent U.S. Appl. No. 14/926,953, dated Jul. 28, 2017.
Notice of Allowance issued in parent U.S. Appl. No. 14/926,953, dated May 10, 2018.
Office Action issued in corresponding Chinese Application No. 201710859197.8, dated Mar. 5, 2019.
Korean Office Action dated Jun. 27, 2019 issued in Korean Patent Application No. 10-2019-0067292 (with English translation).
Office Action issued in corresponding Korean Application No. 10-2015-0078152, dated Apr. 6, 2019.
Japanese Office Action dated Jul. 2, 2019 issued in Japanese Patent Application No. 2017-129087 (with English translation).
Chinese Office Action dated Sep. 9, 2019 issued in Chinese Patent Application No. 201710859197.8 (with English translation).
Korean Office Action dated Oct. 17, 2019 issued in Korean Patent Application No. 10-2015-0128073 (with English translation).

* cited by examiner

| CLASSIFICATION | L DIRECTION | W DIRECTION |
|---|---|---|
| (a) |  |  |
| (b) |  |  |
| (c) |  |  |

| CLASSIFICATION | CROSS SECTION OF COIL COMPONENT (L DIRECTION) | REMARK | FILLING RATE |
|---|---|---|---|
| (a) |  |  |  |
| (b) |  |  |  |
| (c) |  |  |  |

COIL COMPONENT ASSEMBLY FOR MASS PRODUCTION OF COIL COMPONENTS AND COIL COMPONENTS MADE FROM COIL COMPONENT ASSEMBLY

CROSS-REFERENCE TO RELATED APPLICATIONS

This application is a Divisional of U.S. application Ser. No. 14/926,953, filed on Oct. 29, 2015, which claims benefit of priority to Korean Patent Application Nos. 10-2014-0150755 filed on Oct. 31, 2014 and 10-2015-0128073 filed on Sep. 10, 2015, with the Korean Intellectual Property Office, the disclosures of which are incorporated herein by reference in their entirety.

TECHNICAL FIELD

The present disclosure relates to a coil component, such as an inductor, or the like.

BACKGROUND

An inductor, one example of a coil component, is a representative passive element configuring an electronic circuit together with a resistor and a capacitor to remove noise. For example, a power inductor may be used in a power supply circuit, a converter circuit, or the like, through which a high amount of current flows.

Meanwhile, a wound coil component of which a manufacturing method is relatively simple may mainly be used as a coil component. In general, the wound coil component is manufactured using a molding method in which a wound coil is disposed in a mold and a sealing material is provided and then cured.

Recently, components have been thinned and miniaturized, and in a case of manufacturing a small sized coil component using a molding method, there is a limitation in stably mounting a coil. In addition, since the coil component should be individually manufactured, productivity may be decreased.

SUMMARY

An aspect of the present disclosure may provide a coil component in which a coil may be stably mounted even in the case of a small sized coil component and which may be mass-produced.

According to an aspect of the present disclosure, a coil component may be manufactured by a method using a support member having a plurality of processed spaces.

According to another aspect of the present disclosure, a coil component assembly may include a support member, a plurality of processed spaces penetrating through the support member, a plurality of coils disposed in the plurality of processed spaces, respectively, and a magnetic material covering the support member and the plurality of coils.

According to another aspect of the present disclosure, a coil component may be formed by dicing a coil component assembly including a support member, a plurality of processed spaces penetrating through the support member, a plurality of coils disposed in the plurality of processed spaces, respectively, and a magnetic material covering the support member and the plurality of coils along boundary lines between the plurality of processed spaces. The coil component includes a coil and a magnetic body covering the coil.

According to another aspect of the present disclosure, a method for manufacturing a coil component assembly, the method comprising steps of forming a plurality of spaces penetrating through a support member, disposing a plurality of coils in the plurality of spaces, respectively, and forming a magnetic material to cover the support member and the plurality of coils.

According to another aspect of the present disclosure, a method for manufacturing coil components may include steps of forming a plurality of spaces penetrating through a support member, disposing a plurality of coils in the plurality of spaces, respectively, forming a magnetic material to cover the support member and the plurality of coils so as to form a coil component assembly, and cutting the coil component assembly to form the coil components.

BRIEF DESCRIPTION OF THE DRAWINGS

The above and other aspects, features and advantages of the present disclosure will be more clearly understood from the following detailed description taken in conjunction with the accompanying drawings, in which.

DETAILED DESCRIPTION

Figure 1:
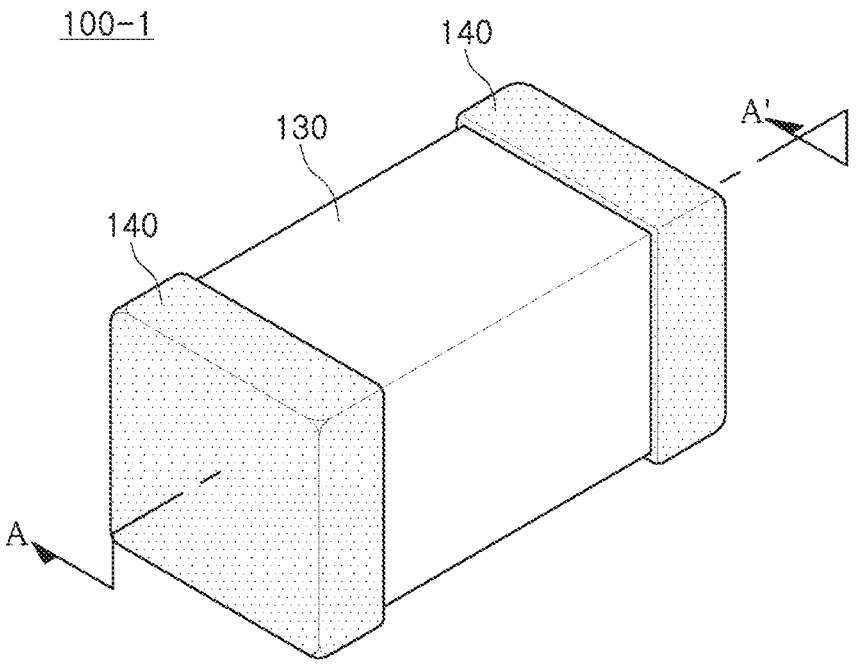
FIG. 1 is a perspective view schematically illustrating an example of a coil component.

Hereinafter, embodiments of the present disclosure will be described in detail with reference to the accompanying drawings. The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. In the drawings, the shapes and dimensions of elements may be exaggerated for clarity, and the same reference numerals will be used throughout to designate the same or like elements.

FIG. 1 is a schematic perspective view illustrating an example of a coil component.

Referring to FIG. 1, a coil component 100-1 may include a coil (not illustrated), a magnetic body 130, and external electrodes 140. The magnetic body 130 may form an exterior of the coil component 100-1 while filling an internal portion of the coil component 100-1 by filling a peripheral space of the coil (not illustrated).

The magnetic body 130 may be formed of a magnetic material-resin composite in which a magnetic metal powder and a resin mixture are mixed with each other, but is not limited thereto. The magnetic metal powder may contain iron (Fe), chromium (Cr), or silicon (Si) as a main ingredient. For example, the magnetic metal powder may contain Fe—Ni, Fe, Fe—Cr—Si, or the like. The resin mixture may contain an epoxy, polyimide, a liquid crystal polymer (LCP), or the like.

Magnetic metal powder particles having at least two particle sizes may be provided in the magnetic body 130. In this case, the magnetic material-resin composite may be fully provided in the magnetic body by using bimodal magnetic metal powder particles having different sizes and compressing the bimodal magnetic metal powder particles, such that a filling rate thereof may be increased.

The external electrodes 140 may be electrically connected to the coil (not illustrated). Here, although a case in which the external electrodes 140 are disposed on two ends of the coil component 100-1 opposing each other is illustrated in FIG. 1, this is only an example. A disposition form of the external electrodes 140 may be variously changed depending on the kind of coil component 100-1 or requirements in a design or process of the coil component 100-1. The external electrodes 140 may contain a metal such as silver (Ag), Ag—Pd, nickel (Ni), copper (Cu), or the like, and Ni plating layers and tin (Sn) plating layers may be selectively formed on surfaces of the external electrodes 140.

Figure 2:
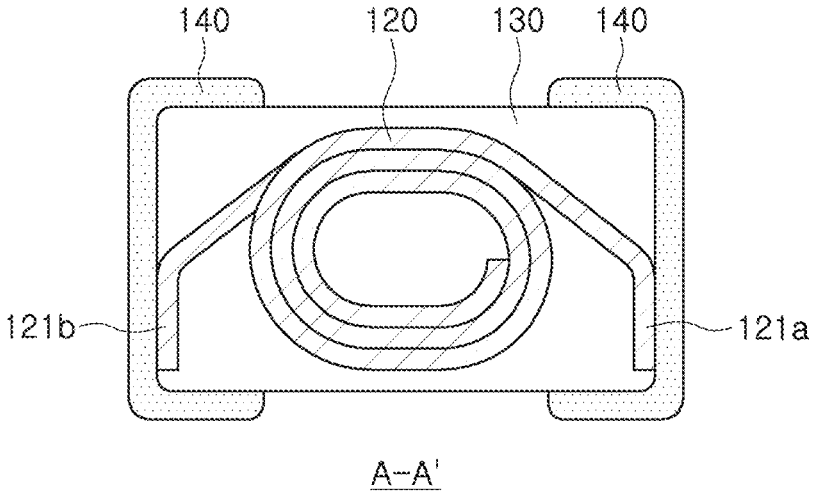
FIG. 2 is a cross-sectional view of the coil component taken along line A-A' of FIG. 1.

FIG. 2 is a cross-sectional view of the coil component taken along line A-A' of FIG. 1.

Referring to FIG. 2, a peripheral space of a coil 120 may be filled by the magnetic body 130, and lead terminals 121*a* and 121*b* of the coil 120 may be connected to the external electrodes 140. The coil 120 may be positioned in the center portion of the magnetic body 130 as illustrated in FIG. 2, but is not limited thereto. For instance, the coil 120 may be positioned in an upper or lower end portion of the magnetic body 130 depending on the kind of coil component 100-1 or requirements in the design or process of the coil component 100-1. The coil 120 may be a wound coil formed by a winding method, but is not limited thereto.

Although described in detail below, the coil 120 may be seated in a processed space (not illustrated) of a support member (not illustrated), and a peripheral space of the coil 120 may be filled by the magnetic body 130. Thus, the coil 120 may be stably mounted in the magnetic body 130, and the coil component 100-1 may also be significantly reduced. However, in some cases, the support member (not illustrated) may be completely removed by dicing, and thus, the support member (not illustrated) may not remain inside an individual component as illustrated in FIG. 2.

A core may be formed in a central hole of the coil 120, and the core may be filled with a magnetic material, and thus a high-inductance coil component may be provided.

Figure 3A:
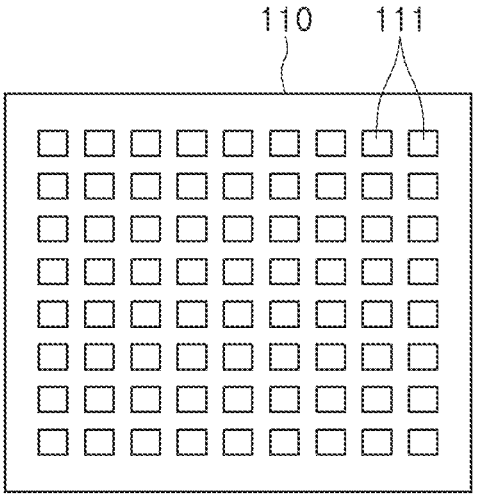
FIGS. 3A through 3C are views detailing a support member and a processed space.
Figure 3B:
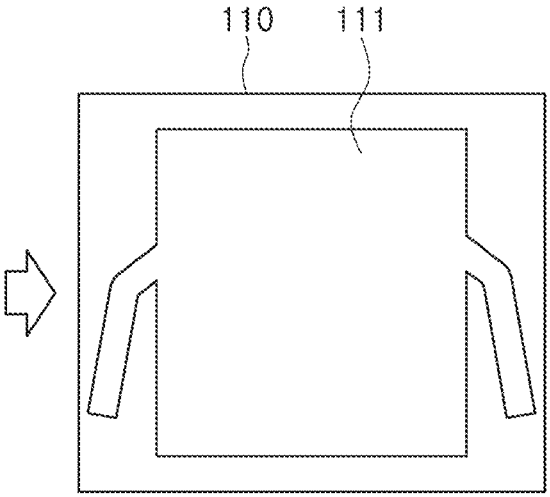
Figure 3C:
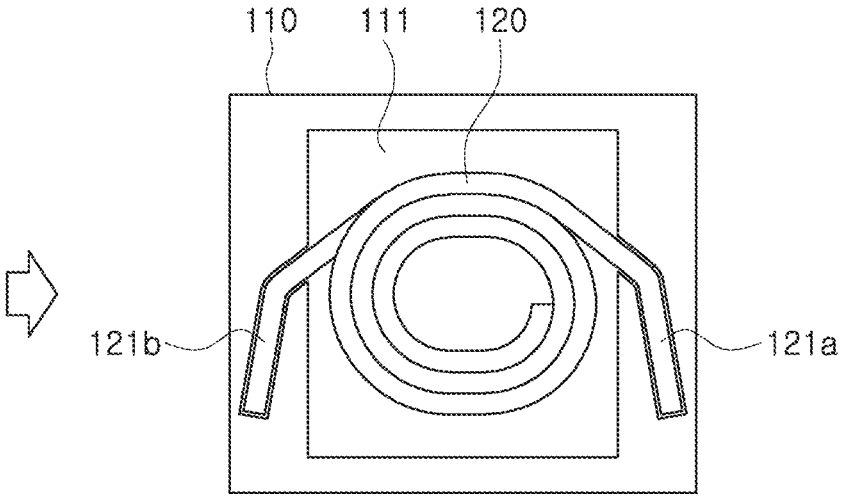

FIGS. 3A through 3C are views detailing the support member and the processed space.

Referring to FIG. 3A, a support member 110 may have a plurality of processed spaces 111. As the support member 110, a copper clad lamination (CCL), a rolled copper plate, a NiFe rolled copper plate, a Cu alloy plate, a ferrite board, a flexible board, or the like, may be used. In a case of using the ferrite board instead of a printed circuit board (PCB), the ferrite board may improve inductance characteristics by increasing permeability. Further, the ferrite board may more stably fix the coil 120.

Referring to FIG. 3B, each of the processed spaces 111 may be formed so that the coil 120 may be stably mounted. The processed space 111 may have a length larger than a width based on the accompanying drawings. Formed sheets may be stacked in the processed space 111, and the stacked sheets may be compressed and cured, thereby preventing position misalignment of the coil 120 disposed on a predetermined position and controlling deformation of a bar due to movement of the sheets. Here, "processing" at least a portion of the support member 110 may include forming a space through a structure composed of two or more support members as well as forming a space by physically, optically, or chemically deforming or removing at least a portion of the support member 110.

Referring to FIG. 3C, the coil 120 may be disposed in each of the processed spaces 111. The processed space 111 may have a sufficiently and relatively large size in order to accommodate the coil 120. When the coil 120 is accommodated in the processed space 111, an empty space may be formed, and the magnetic material may be provided in the empty space by compressing formed magnetic sheets.

Figure 4A:
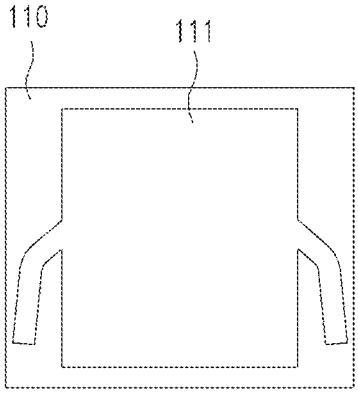
FIGS. 4A and 4B are views illustrating various processed spaces of the support member.
Figure 4B:
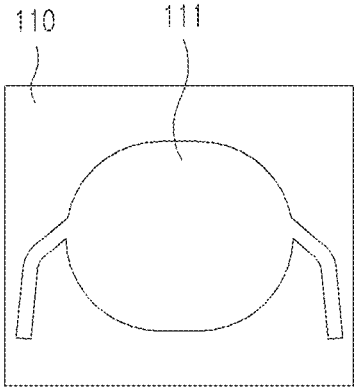

FIGS. 4A and 4B are views illustrating various processed spaces of the support member.

Referring to FIGS. 4A and 4B, in an at least partially processed space 111 formed in the support member 110, a space in which the coil 120 is disposed may have a polygonal shape such as a quadrangular shape, or the like, as in FIG. 4A, or may have an oval shape similar to a shape of the coil 120 as in FIG. 4B. However, the shape of the space is not limited thereto, and the space may also have various shapes. Mounting spaces in which the lead terminals 121*a* and 121*b* of the coil 120 are disposed may be separately or simultaneously formed, together with the space in which the coil 120 is disposed. The mounting spaces in which the lead terminals 121*a* and 121*b* of the coil 120 are disposed and the space in which the coil 120 is disposed may be integrally formed.

Figure 5A:
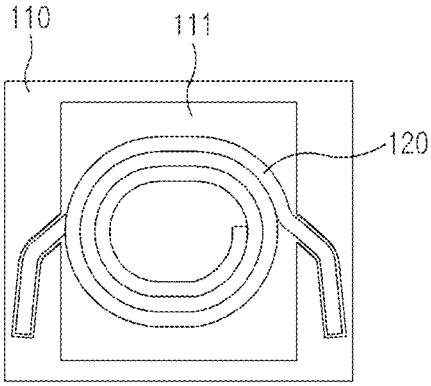
FIGS. 5A and 5B are views illustrating various lead terminals of a coil.
Figure 5B:
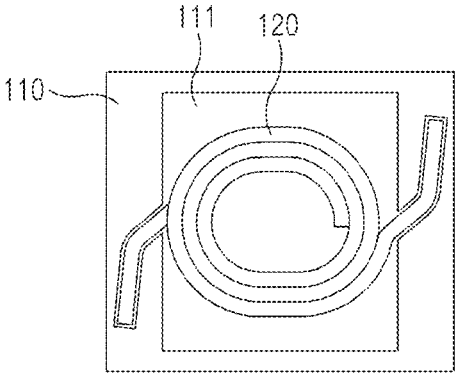

FIGS. 5A and 5B are views illustrating various lead terminals of the coil.

Referring to FIGS. 5A and 5B, the at least partially processed space of the support member 110 may also accommodate the lead terminals 121*a* and 121*b* of the coil 120. Here, portions of the processed space accommodating the lead terminals 121*a* and 121*b* may have a bent shape, which may allow for an increase in an area of the support member 110 by areas corresponding to the portions of the processed space accommodating two lead terminals as compared to a straight shape.

Further, the lead terminals 121*a* and 121*b* may be bent in the same direction as each other or in different directions from each other. Therefore, the portions of the processed space accommodating the lead terminals 121*a* and 121*b* may also have shapes bent in the same directions as in FIG. 5A or bent in different directions from each other as in FIG. 5B.

Figure 6:
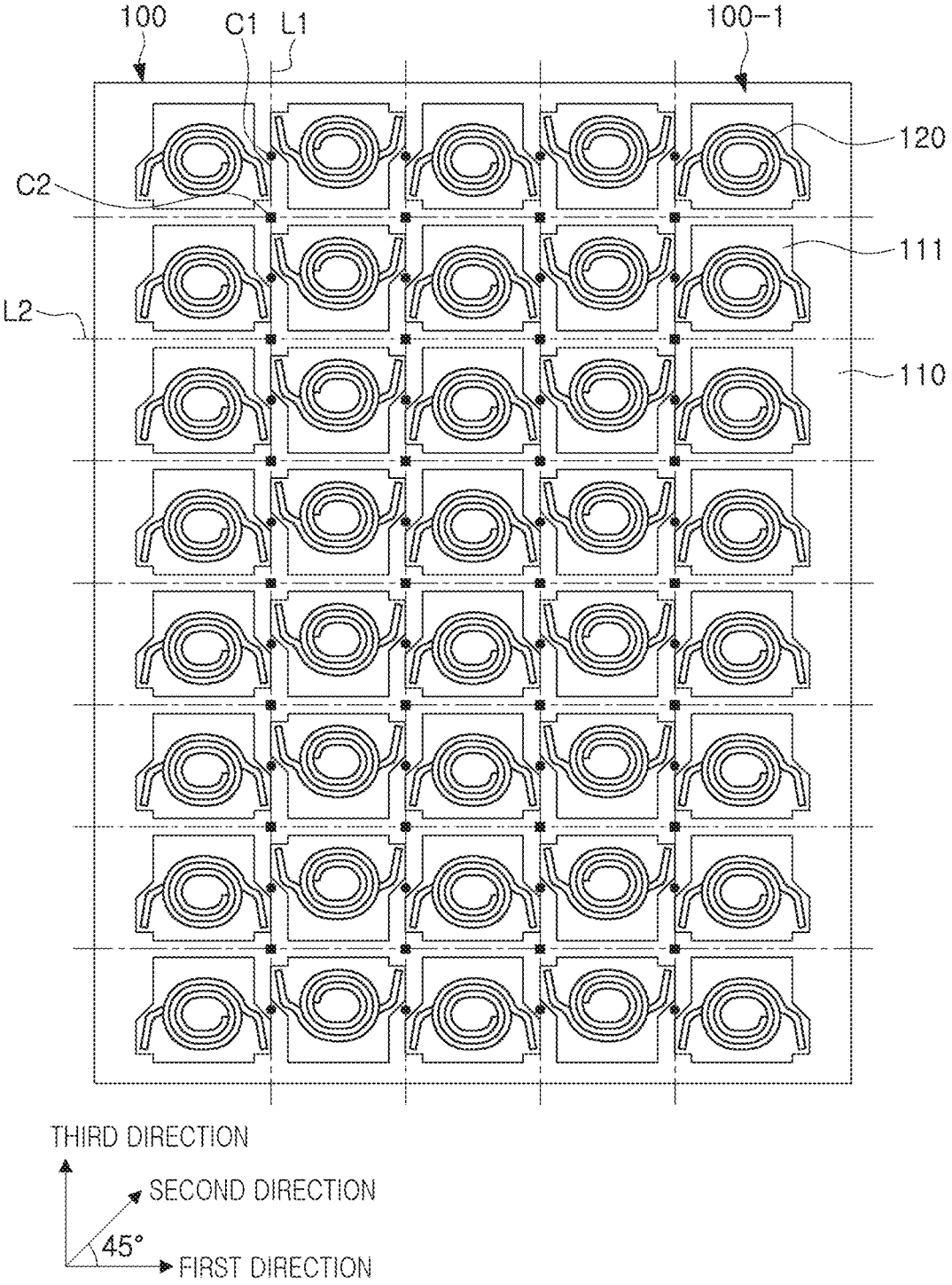
FIG. 6 is a plan view illustrating an example of a coil component assembly.

FIG. 6 is a plan view illustrating an example of a coil component assembly.

Referring to FIG. 6, a coil component assembly 100 may include a support member 110 having a plurality of processed spaces 111, a plurality of coils 120 disposed in the plurality of processed spaces 111, respectively, and a magnetic material (not illustrated) covering the support member 110 and the coils 120. In this case, according to the exemplary embodiment in the present disclosure, lead terminals of the coil 120 may be bent in the same direction as each other, and thus the processed space 111 may also be further processed in accordance with the lead terminals. Each of the plurality of processed spaces 111 may have protrusion portions on opposite sides thereof in a first direction. Among the plurality of processed spaces 111, two arbitrary processed spaces adjacent to each other in the first direction may be processed so that respective protrusion portions thereof alternate with each other so as to enable adjacent protrusion portions to nest with respect to each other. Each of the plurality of coils 120 may have lead terminals protruding on opposite sides thereof in the first direction. Among the plurality of coils 120, two arbitrary coils adjacent to each other in the first direction may be disposed so that respective lead terminals thereof alternate with each other.

Meanwhile, on a plane of the support member 110, among the plurality of processed spaces 111, two arbitrary processed spaces adjacent to each other in the first direction may be point-symmetrical to each other with respect to a central point C1 of a boundary line L1 therebetween. When two arbitrary processed spaces are point-symmetrical to each other with respect to the central point C1 of the boundary line L1, a space of the support member 110 may be significantly utilized. In addition, in spite of miniaturization of a coil component 100-1, since the processed spaces 111 substantially equal to each other are repeated, the coils 120 may be more easily and simply loaded, and thus disposition accuracy of the coils 120 may be further improved.

In this case, on the plane of the support member 110, among the plurality of coils 120 disposed in the plurality of processed spaces 111, respectively, two arbitrary coils adjacent to each other in the first direction may also be point-symmetrical to each other with respect to a central point C1 of a boundary line L1 therebetween. The coils 120 may also be disposed to be point-symmetrical to each other with respect to the central point C1 of the boundary line L1 in accordance with the processed spaces 111, and thus the above-mentioned effect may be actually implemented.

Further, among the plurality of processed spaces 111, two arbitrary processed spaces adjacent to each other in a second direction at 45° with respect to the first direction based on the plane of the support member 110 may be point-symmetrical to each other with respect to an intersecting point C2 of boundary lines L1 and L2 perpendicular to each other between the processed spaces. When two arbitrary processed spaces adjacent to each other in the second direction at 45° with respect to the first direction are point-symmetrical to each other with respect to the intersecting point C2 of the boundary lines L1 and L2, the space of the support member 110 may be significantly utilized. Further, in spite of miniaturization of the coil component 100-1, since the processed spaces 111 substantially equal to each other are repeated, the coils 120 may be more easily and simply loaded, and thus disposition accuracy of the coils 120 may be further improved. It should be appreciated that the second direction being at 45° with respect to the first direction is merely an example. According to another embodiment, the second direction may be along a diagonal passing through corners formed by two adjacent boundary lines L1 and two adjacent boundary lines L2, based on the plane of the support member 110. Thus, an angle between the second direction and the first direction may be determined by an interval between the two adjacent boundary lines L1 and an interval between the two adjacent boundary lines L2.

In this case, among the plurality of coils 120 disposed in the plurality of processed spaces 111, respectively, two arbitrary coils adjacent to each other in the second direction at 45° with respect to the first direction based on the plane of the support member 110 may also be point-symmetrical to each other with respect to an intersecting point C2 of boundary lines L1 and L2 perpendicular to each other between the coils. The coils 120 may also be disposed to be point-symmetrical to each other with respect to the intersecting point C2 of the boundary lines L1 and L2 in accordance with the processed spaces 111, and thus the space of the support member 110 may be significantly utilized.

Meanwhile, the term "symmetrical" as used herein may include the meaning of "substantially symmetrical" in consideration of an error that may occur in terms of limitation in a process, equipment, or the like, as well as including "completely symmetrical".

Figure 7:
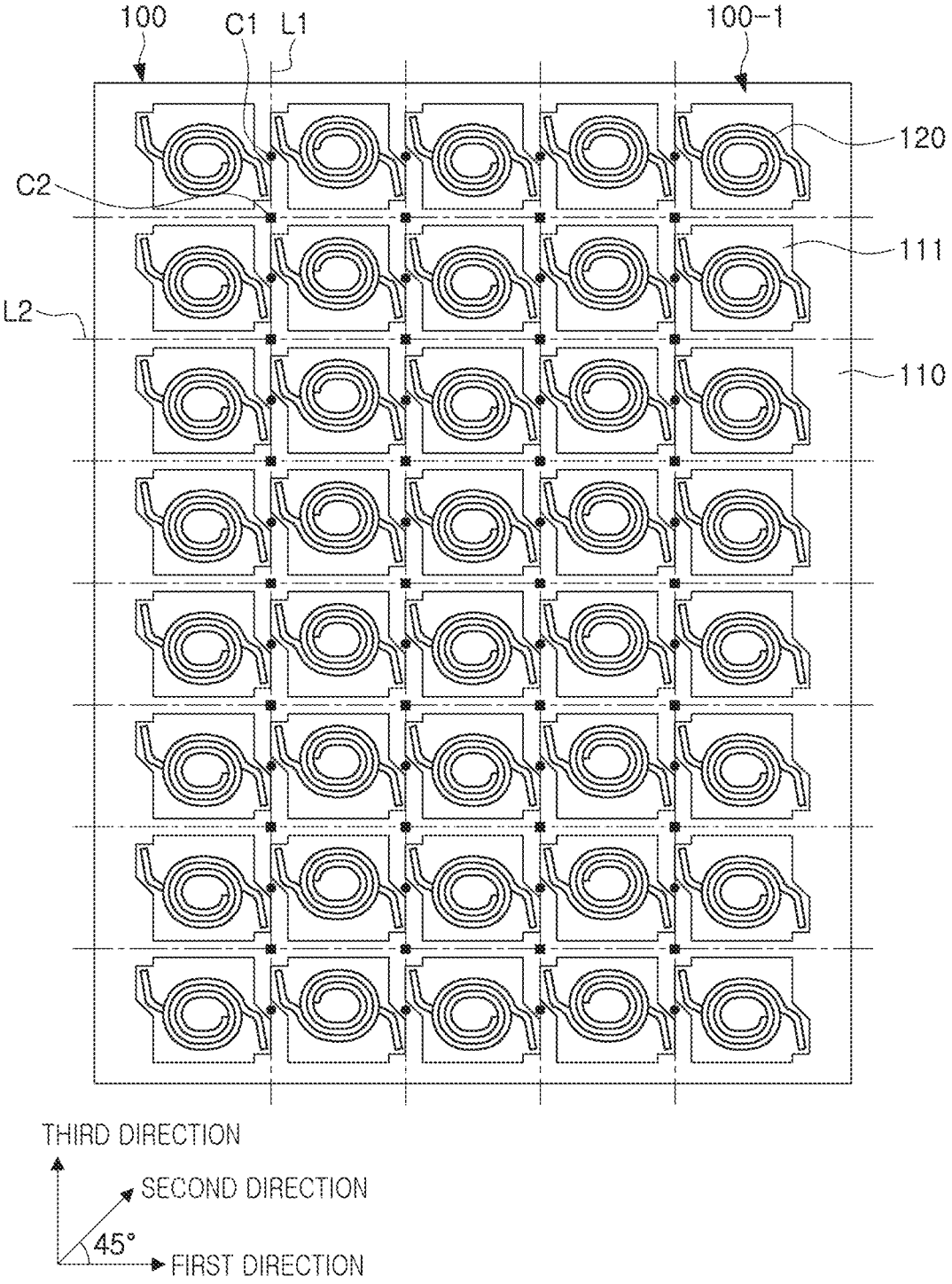
FIG. 7 is a plan view illustrating an example of a coil component assembly.

FIG. 7 is a plan view illustrating a coil component assembly according to another exemplary embodiment in the present disclosure.

In the coil component assembly according to another exemplary embodiment illustrated in FIG. 7, lead terminals of a coil 120 may be bent in different directions from each other as compared to the coil component assembly according to the exemplary embodiment illustrated in FIG. 6, and processed spaces 111 may also be processed in accordance therewith. Each of the plurality of processed spaces 111 may have protrusion portions on opposite sides thereof in a first direction. Among the plurality of processed spaces 111, two arbitrary processed spaces adjacent to each other in the first direction may be processed so that respective protrusion portions thereof alternate with each other so as to enable adjacent protrusion portions to nest with respect to each other. Each of the plurality of coils 120 may have lead terminals protruding on opposite sides thereof in the first direction. Among the plurality of coils 120, two arbitrary coils adjacent to each other in the first direction may be disposed so that respective lead terminals thereof alternate with each other.

For example, when the lead terminals of the coil 120 are bent in different directions from each other and the processed space 111 is also processed in accordance therewith, among the plurality of processed spaces 111, two arbitrary processed spaces adjacent to each other in the first direction on a plane of a support member 110 may also be point-symmetrical to each other with respect to a central point C1 of a boundary line L1 therebetween. In this case, among the plurality of coils 120 disposed in the plurality of processed spaces 111 on the plane of the support member 110, respectively, two arbitrary coils adjacent to each other in the first direction may also be point-symmetrical to each other with respect to a central point C1 of a boundary line L1 therebetween.

Further, among the plurality of processed spaces 111, two arbitrary processed spaces adjacent to each other in a second direction at 45° with respect to the first direction based on the plane of the support member 110 may be point-symmetrical to each other with respect to an intersecting point C2 of boundary lines L1 and L2 perpendicular to each other between the processed spaces. In this case, among the plurality of coils 120 disposed in the plurality of processed spaces 111, respectively, two arbitrary coils adjacent to each other in the second direction at 45° with respect to the first direction based on the plane of the support member 110 may also be point-symmetrical to each other with respect to an intersecting point C2 of boundary lines L1 and L2 perpendicular to each other between the coils.

Similarly, a space of the support member 110 may be significantly utilized, and in spite of miniaturization of a coil component 100-1, since the processed spaces 111 substantially equal to each other are repeated, the coils 120 may be more easily and simply loaded, and thus disposition accuracy of the coils 120 may be further improved.

Figure 8:
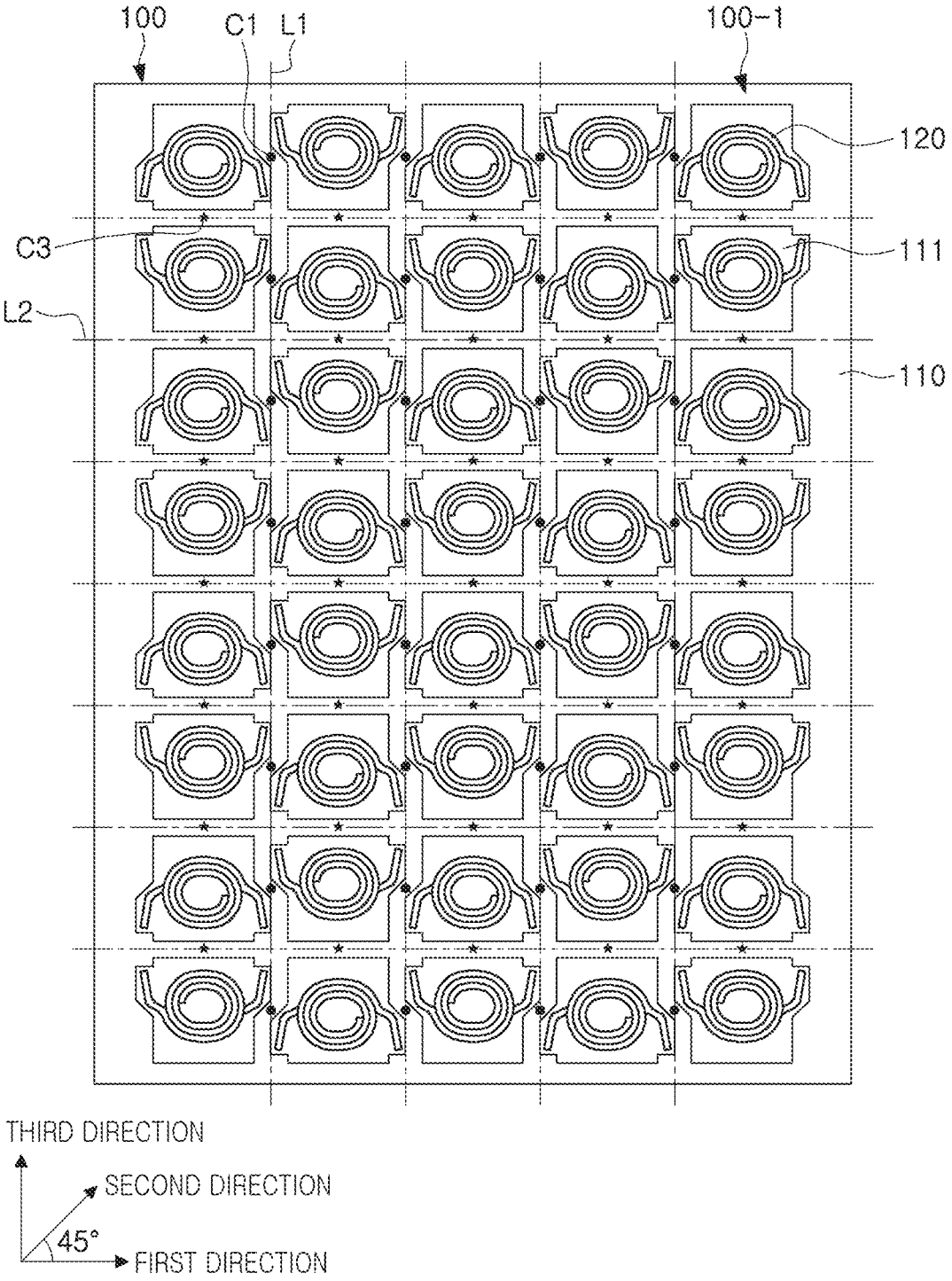
FIG. 8 is a plan view illustrating an example of a coil component assembly.

FIG. 8 is a plan view illustrating a coil component assembly according to another exemplary embodiment in the present disclosure.

Referring to FIG. 8, a coil component assembly 100 may include a support member 110 having a plurality of processed spaces 111, a plurality of coils 120 disposed in the plurality of processed spaces 111, respectively, and a magnetic material (not illustrated) covering the support member 110 and the coils 120. In this case, according to another exemplary embodiment in the present disclosure, lead terminals of the coil 120 may be bent in the same direction as each other, and thus the processed space 111 may also be processed in accordance with therewith. Each of the plurality of processed spaces 111 may have protrusion portions on opposite sides thereof in a first direction. Among the plurality of processed spaces 111, two arbitrary processed spaces adjacent to each other in the first direction may be processed so that respective protrusion portions thereof alternate with each other so as to enable adjacent protrusion portions to nest with respect to each other. Each of the plurality of coils 120 may have lead terminals protruding on opposite sides thereof in the first direction. Among the plurality of coils 120, two arbitrary coils adjacent to each other in the first direction may be disposed so that respective lead terminals thereof alternate with each other.

Meanwhile, on a plane of the support member 110, among the plurality of processed spaces 111, two arbitrary processed spaces adjacent to each other in the first direction may be point-symmetrical to each other with respect to a central point C1 of a boundary line L1 therebetween. When two arbitrary processed spaces are point-symmetrical to each other with respect to the central point C1 of the boundary line L1 as described above, a space of the support member 110 may be significantly utilized. In spite of miniaturization of a coil component 100-1, since the processed spaces 111 substantially equal to each other are repeated, the coils 120 may be more easily and simply loaded. Thus disposition accuracy of the coils 120 may be further improved.

In this case, on the plane of the support member 110, among the plurality of coils 120 disposed in the plurality of processed spaces 111, respectively, two arbitrary coils adjacent to each other in the first direction may also be point-symmetrical to each other with respect to a central point C1 of a boundary line L1 therebetween. The coils 120 may also be disposed to be point-symmetrical to each other with respect to the central point C1 of the boundary line L1 in accordance with the processed spaces 111, and thus the above-mentioned effect may be actually implemented.

However, unlike the exemplary embodiments illustrated in FIGS. 6 and 7, on the plane of the support member 110, among the plurality of processed spaces 111, two arbitrary processed spaces 111 adjacent to each other in a third direction at 90° with respect to the first direction may be point-symmetrical to each other with respect to a central point C3 of a boundary line L2 therebetween. When two arbitrary processed spaces are point-symmetrical to each other with respect to the central point C3 of the boundary line L2, the space of the support member 110 may also be significantly utilized. Since the processed spaces 111 substantially equal to each other are repeated, the coils 120 may be more easily and simply loaded in spite of miniaturization of the coil component 100-1. Thus disposition accuracy of the coils 120 may be further improved.

In this case, on the plane of the support member 110, among the plurality of coils 120 disposed in the plurality of processed spaces 111, respectively, two arbitrary coils 120 adjacent to each other in the third direction at 90° with respect to the first direction may also be point-symmetrical to each other with respect to a central point C3 of a boundary line L2 therebetween. The coils 120 may also be disposed to be point-symmetrical to each other with respect to the central point C3 of the boundary line L2 in accordance with the processed spaces 111, and thus the above-mentioned effect may be substantially implemented, for example, the space of the support member 110 may be significantly utilized.

Figure 9:
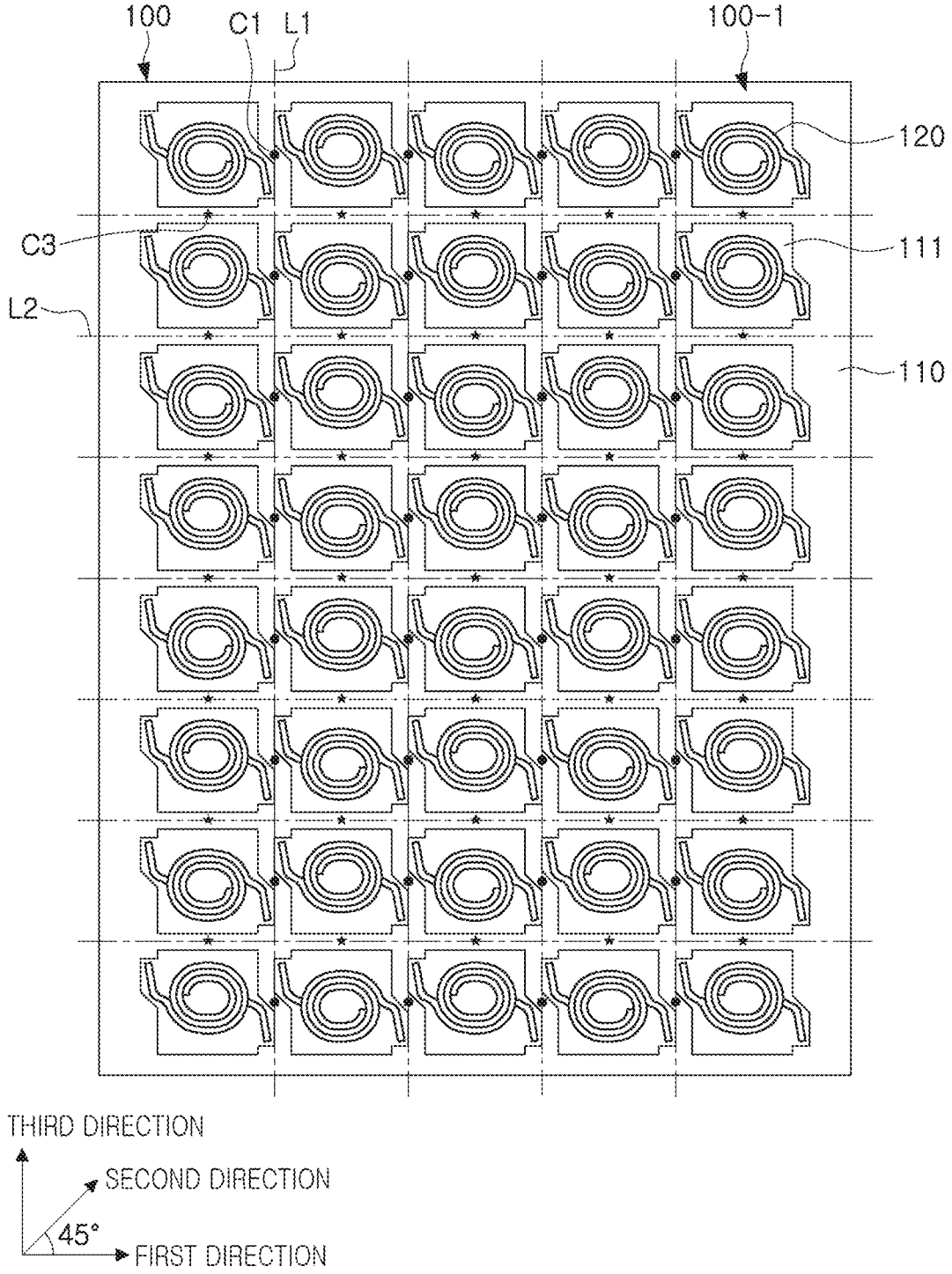
FIG. 9 is a plan view illustrating an example of a coil component assembly.

FIG. 9 is a plan view illustrating a coil component assembly according to another exemplary embodiment in the present disclosure.

In the coil component assembly according to another exemplary embodiment illustrated in FIG. 9, lead terminals of a coil 120 may be bent in different directions from each other as compared to the coil component assembly according to another exemplary embodiment illustrated in FIG. 8, and processed spaces 111 may also be processed in accordance therewith. A plurality of processed spaces 111 may have protrusion portions on opposite sides thereof in a first direction, respectively. Among the plurality of processed spaces 111, two arbitrary processed spaces adjacent to each other in the first direction may be processed so that respective protrusion portions thereof alternate with each other so as to enable adjacent protrusion portions to nest with respect to each other. A plurality of coils 120 may have lead terminals protruding on opposite sides thereof in the first direction, respectively. Among the plurality of coils 120, two arbitrary coils adjacent to each other in the first direction may be disposed so that respective lead terminals thereof alternate with each other.

When the lead terminals of the coil 120 are bent in different directions from each other and the processed space 111 is also processed in accordance with the lead terminals, on a plane of a support member 110, among the plurality of processed spaces 111, two arbitrary processed spaces adjacent to each other in the first direction may also be point-symmetrical to each other with respect to a central point C1 of a boundary line L1 therebetween. In this case, on the plane of the support member 110, among the plurality of coils 120 disposed in the plurality of processed spaces 111, respectively, two arbitrary coils adjacent to each other in the first direction may also be point-symmetrical to each other with respect to the central point C1 of the boundary line L1 therebetween.

Further, on the plane of the support member 110, among the plurality of processed spaces 111, two arbitrary processed spaces 110 adjacent to each other in a third direction at 90° with respect to the first direction may be point-symmetrical to each other with respect to a central point C3 of a boundary line L2 therebetween. In this case, on the plane of the support member 110, among the plurality of coils 120 disposed in the plurality of processed spaces 111, respectively, two arbitrary coils 120 adjacent to each other in the third direction at 90° with respect to the first direction may also be point-symmetrical to each other with respect to a central point C3 of a boundary line L2 therebetween.

Similarly, a space of the support member 110 may be significantly utilized, and since the processed spaces 111 substantially equal to each other are repeated, the coils 120 may be more easily and simply loaded even in the case of miniaturization of a coil component 100-1. Thus disposition accuracy of the coils 120 may be further improved.

FIGS. 10A through 10E are schematic process sequence views illustrating an example of a method of manufacturing a coil component using a coil component assembly.

Figure 10A:
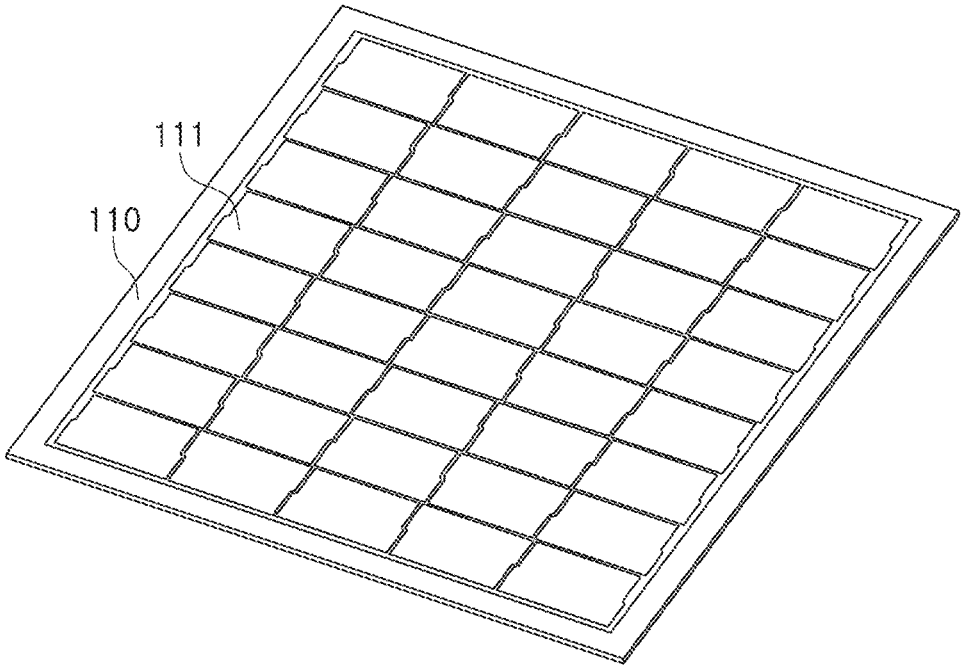
FIGS. 10A through 10E are process sequence views schematically illustrating an example of a method of manufacturing a coil component using a coil component assembly.

Referring to FIG. 10A, a support member 110 having a plurality of processed spaces 111 may be prepared. As the support member 110, a copper clad lamination (CCL), a rolled copper plate, a NiFe rolled copper plate, a Cu alloy plate, a ferrite board, a flexible board, or the like, may be used. The processed spaces 111 may be formed respectively so that a coil 120 may be stably mounted therein. The processed space 111 may have a length larger than a width based on the accompanying drawings. A detailed disposition form of the processed spaces 111 may be referred to in the illustration of FIGS. 6 through 9. The plurality of processed spaces 111 may penetrate through the support member 110.

Figure 10B:
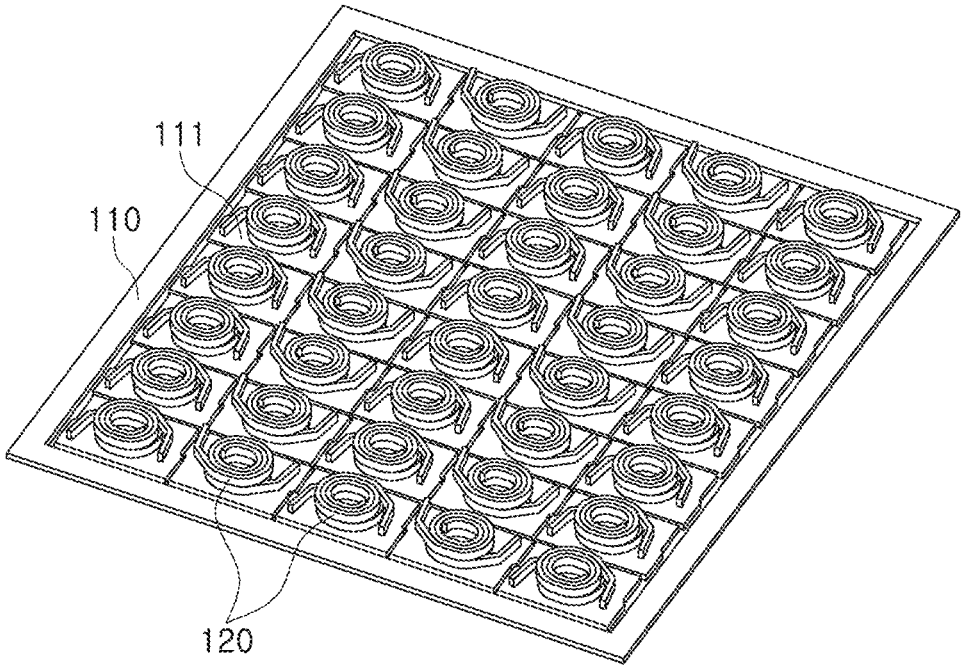

Referring to FIG. 10B, the coils 120 may respectively be disposed in the processed spaces 111. For instance, a plurality of coils may be loaded in the plurality of processed spaces 111 of the support member 110, which may be effective for mass-production. A detailed disposition form of the coil 120 may be referred to the illustration of FIGS. 6 through 9. Each of the processed spaces 111 may have a sufficiently large size in order to accommodate the coil 120. When the coil 120 is accommodated in the processed space 111, an empty space may be formed. The coil 120 may be a wound coil formed by a winding method, but is not limited thereto.

Figure 10C:
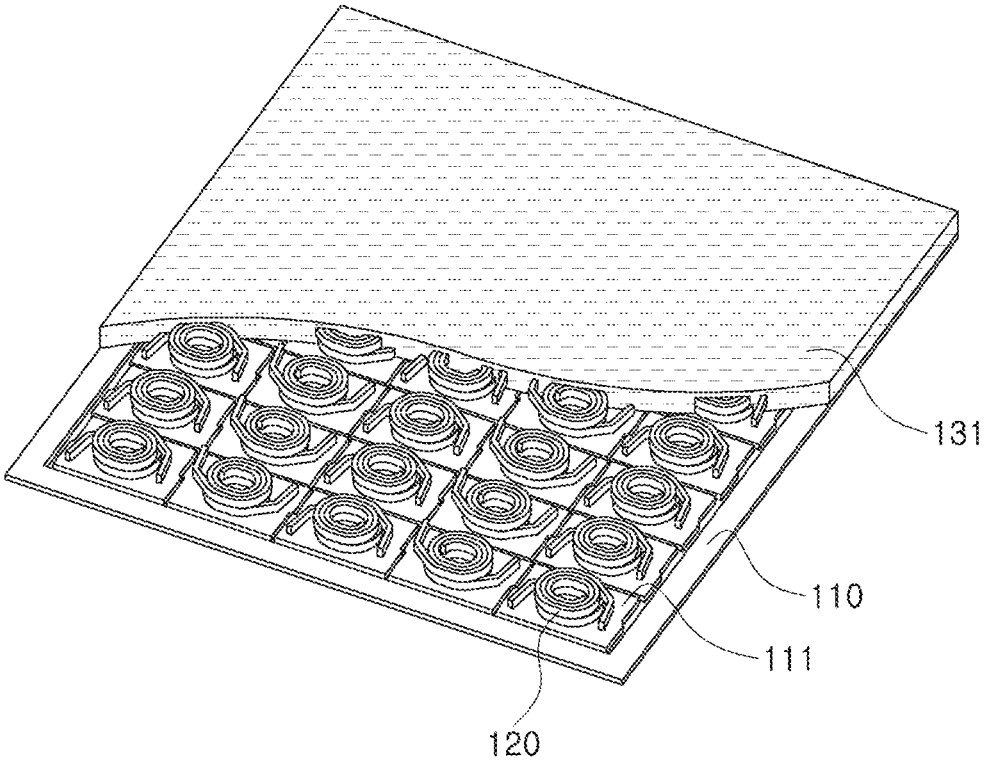

Referring to FIG. 10C, a first magnetic sheet 131 may be compressed on one surface of the support member 110. The first magnetic sheet 131 may be formed of a magnetic material-resin composite in a sheet form and compressed in a semi-cured state. The magnetic material-resin composite may be a mixture of a magnetic metal powder and a resin mixture. The magnetic metal powder may contain Fe, Cr, or Si as a main ingredient, and the resin mixture may be any one of an epoxy, polyimide, a liquid crystal polymer (LCP), and the like, or a combination thereof, but the magnetic metal powder and the resin mixture are not limited thereto. The empty space in the processed space 111 may be filled with a magnetic material such as the magnetic material-resin composite, or the like, by compression of the first magnetic sheet 131. When the first magnetic sheet is subsequently cured, position misalignment of the coil 120 disposed in a predetermined position may be prevented, and deformation of a bar due to movement of the sheet may be controlled.

Figure 10D:
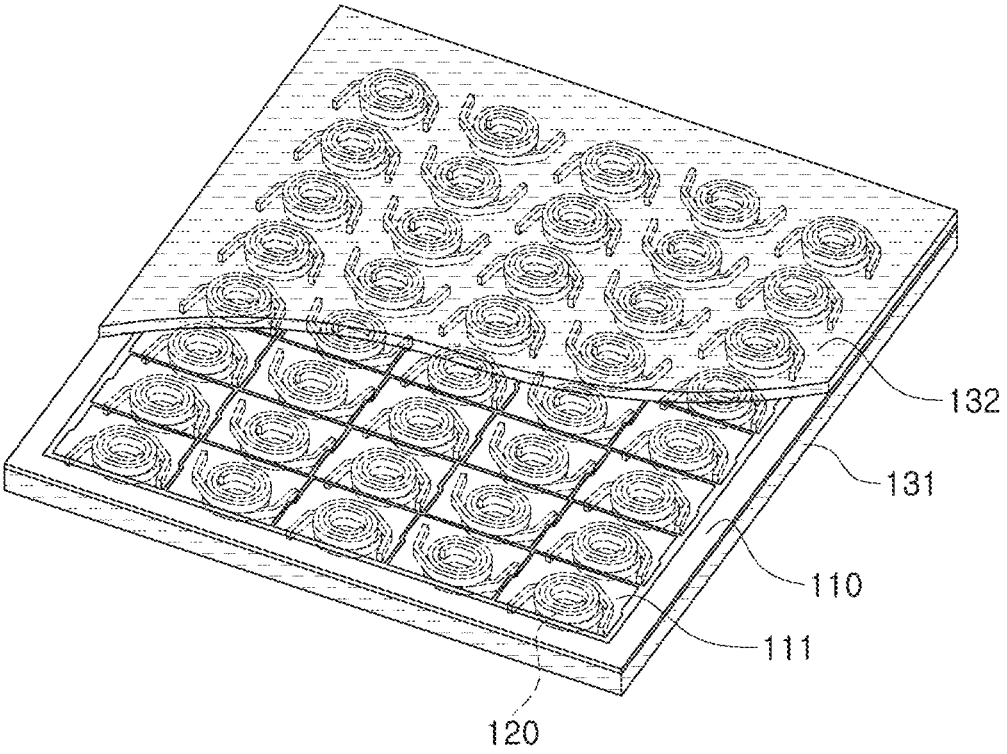

Referring to FIG. 10D, a second magnetic sheet 132 may be compressed on the other surface of the support member 110. The second magnetic sheet 132 may also be formed of a magnetic material-resin composite in a sheet form and compressed in a semi-cured state. The magnetic material-resin composite may be the mixture of a magnetic metal powder and a resin mixture. The magnetic metal powder may contain Fe, Cr, or Si as a main ingredient, and the resin mixture may be any one of an epoxy, polyimide, a liquid crystal polymer (LCP), and the like, or a combination thereof, but the magnetic metal powder and the resin mixture are not limited thereto. When the second magnetic sheet is subsequently cured, position misalignment of the coil 120 disposed in the predetermined position may be prevented, and deformation of the bar due to movement of the sheet may be controlled. The first and second magnetic sheets 131 and 132 may be simultaneously cured or separately cured.

Figure 10E:
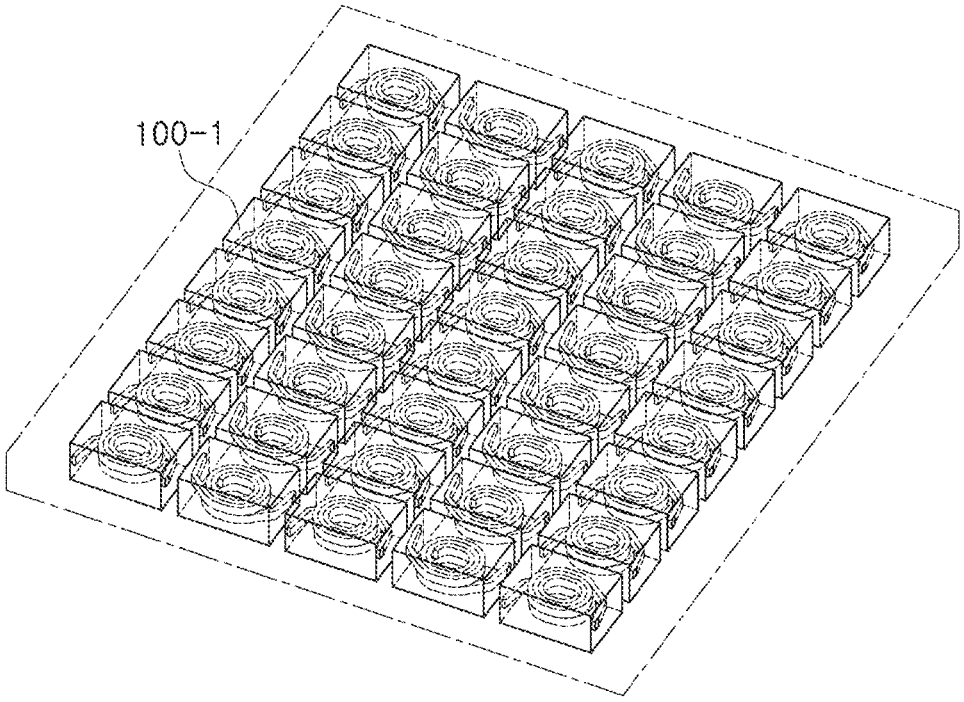

Referring to FIG. 10E, the support member 110 and the first and second magnetic sheets 131 and 132 stacked on two surfaces thereof may be diced along interfaces of the plurality of processed spaces 111. The dicing may be performed in accordance with a size designed in advance, and as a result, individual coil components 100-1 may be formed. The dicing may be performed to form individual coil components using dicing equipment. Alternatively, another dicing method such as a blade method, a laser method, or the like, may be used.

Meanwhile, when the support member 110 and/or a fixation frame (not illustrated) are designed to be smaller than a region diced to thereby be removed by a dicing blade, or the like, (for instance, a dicing kerf region), the support member 110 and/or the fixation frame (not illustrated) may not remain inside the individual coil components 100-1 after dicing. For instance, the support member 110 and/or the fixation frame (not illustrated), the purpose of which are to stably seat the coils 120, may remain or may not remain inside a final component. However, when the support member 110 is designed to significantly be close to the coil 120 in order to improve position fixation precision of the coil 120, the support member 110 and/or the fixation frame (not illustrated) may partially remain inside the coil component.

Although not illustrated, polishing may be performed to polish corners of the individual coil components 100-1 after the dicing. A magnetic body 130 of the coil component 100-1 may have a round shape due to the polishing, and an insulation material may be additionally printed on a surface of the magnetic body 130 to prevent plating. A formed insulation layer may contain at least one of a glass-based material containing Si, an insulation resin, and plasma.

Further, current crowding may be prevented when a plating current is applied by significantly decreasing irregularities of a surface of a diced magnetic body 130 to prevent plating spread. For instance, in the magnetic body 130, the magnetic metal powder may have a hemispherical shape of which a diced and exposed surface is planarized or a shape of which a sphere is partially diced, and thus, the magnetic body 130 may be implemented to have a flat surface, and thus when the plating current is applied, current crowding may be prevented.

In addition, after forming the insulation layer on the magnetic body 130, lead terminals of the coil 120 on which the insulation layer is not formed may be pre-plated with a metal material. A pre-plating layer (not illustrated) may be formed of a metal. For example, the pre-plating layer may be formed by Cu plating. External electrodes (not illustrated) may be formed by applying at least one of Ni and Sn on the pre-plating layer (not illustrated), or external electrodes 140 may be formed by applying at least one of Ni and Sn after applying at least one of Ag and Cu.

For example, Cu plating may be performed on lead terminal portions of the electrodes that are not applied with the insulation material but are externally exposed at a predetermined thickness or more, and thus Ni or Sn plating may be performed without additional application of external electrodes (not illustrated). Therefore, Ag, Cu, or the like, to increase contact force between terminals of the external electrodes (not illustrated) and form the external electrodes 140 may not be separately formed.

Meanwhile, in a case of additional application of at least one of Ag and Cu on the pre-plating layer (not illustrated) to form the external electrodes (not illustrated), relatively wide internal and external contact areas may be secured, thereby obtaining relatively low resistance.

FIGS. 11A through 11D are schematic perspective and cross-sectional views illustrating an example of a coil component.

Figure 11A:
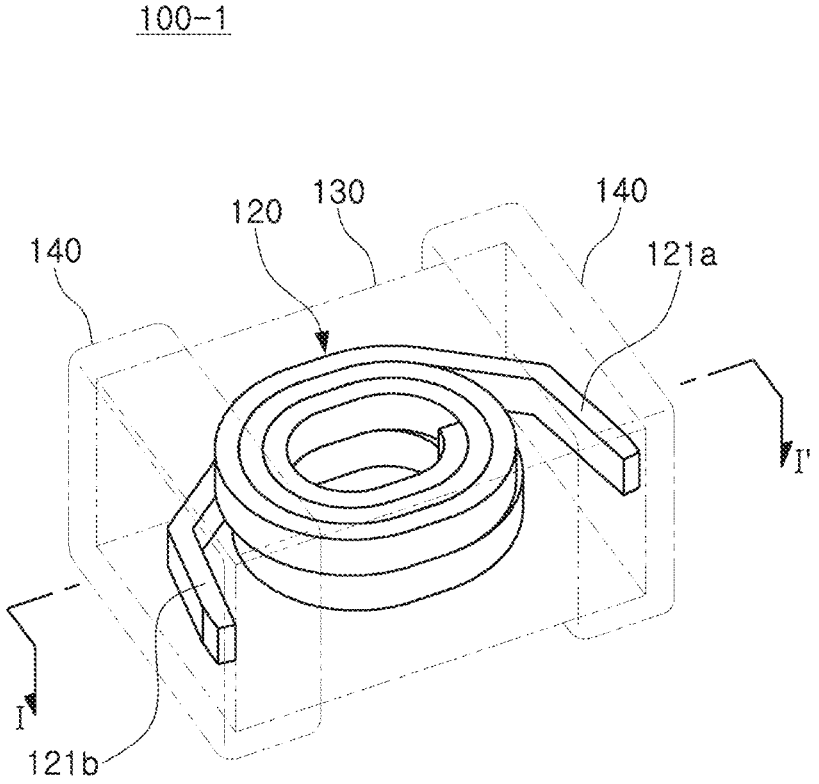
FIGS. 11A through 11D are perspective and cross-sectional views schematically illustrating an example of a coil component.

FIG. 11A is a schematic perspective view of an individual coil component 100-1 manufactured by the above-mentioned process (see FIG. 10A through 10E). Here, an overlapping description will be omitted, and a main configuration will mainly be described.

Referring to FIG. 11A, an individual coil component 100-1 according to the exemplary embodiment in the present disclosure may include a coil 120, a magnetic body 130, and external electrodes 140. The coil component 100-1 may be used as an inductor in electronic/electrical devices. In detail, the coil component 100-1 may be used as a high-current power inductor.

The external electrodes 140 may be electrically connected to lead terminals 121*a* and 121*b* of the coil 120. In this case, although a case in which the external electrodes 140 are disposed on two surfaces of the coil component 100-1 opposing each other is illustrated in FIG. 11A, this is only an example, and a disposition form of the external electrodes 140 may be variously changed depending on the kind of coil component 100-1 or requirements in a design or process of the coil component 100-1.

Figure 11B:
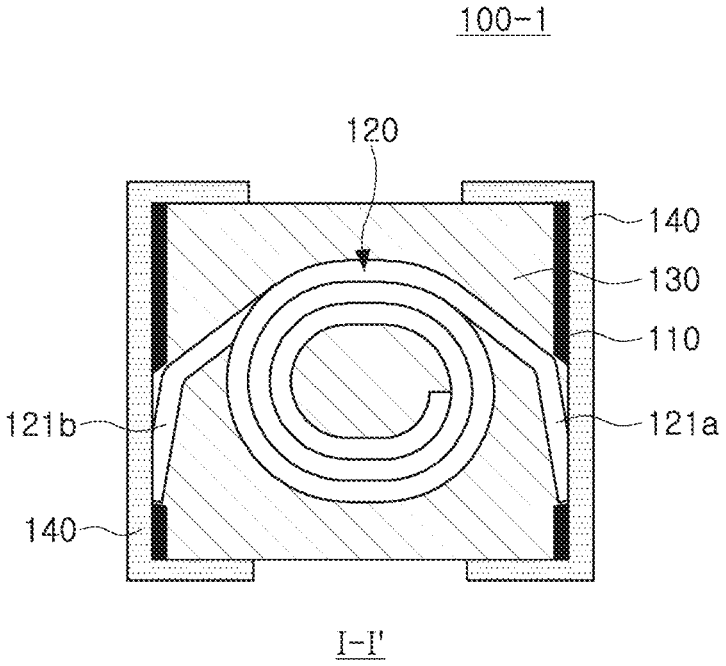
Figure 11C:
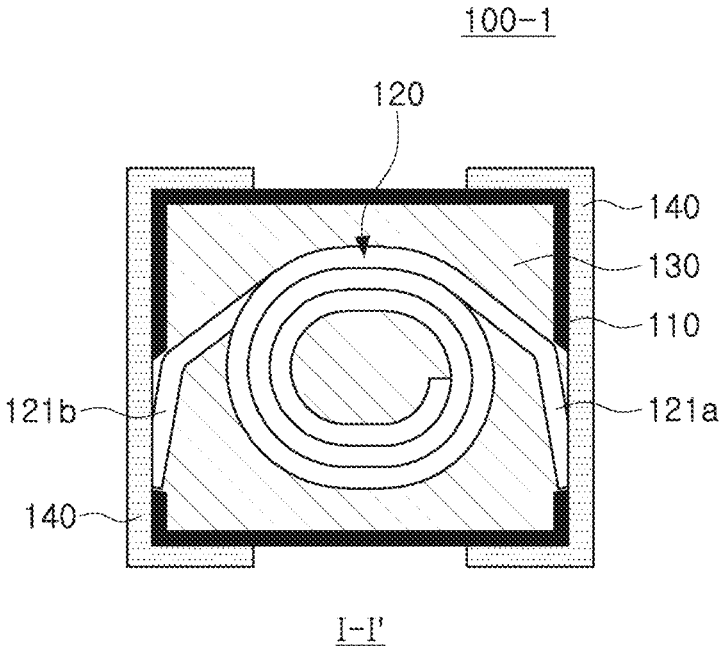
Figure 11D:
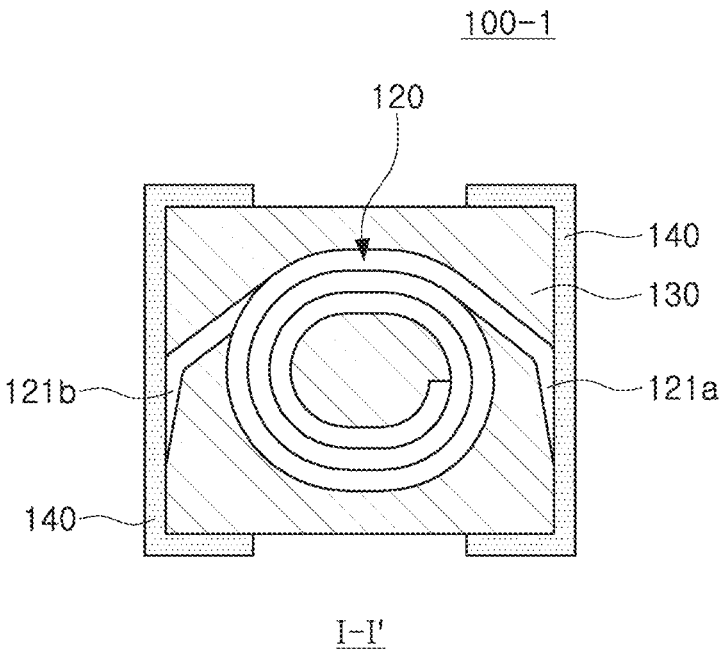

FIGS. 11B through 11D are cross-sectional views of the individual coil component 100-1 taken along line I-I' of FIG. 11A. Here, an overlapping description will be omitted, and a main configuration will mainly be described.

Referring to FIGS. 11B and 11C, the support member 110 may be a base member for manufacturing a coil component and may remain inside the coil component 100-1 after dicing. In this case, the support member 110 may only remain on opposite sides of the coil component 100-1 in the first direction as illustrated in FIG. 11B, or may remain at both the first and third directions as illustrated in FIG. 11C.

The coil 120 may be a wound coil formed by a winding method. Further, an at least partially processed space of the support member 110 may accommodate an entire body of the coil 120 and two lead terminals 121*a* and 121*b*. The lead terminals 121*a* and 121*b* of the coil 120 may be connected to the external electrodes 140, respectively.

The coil 120 may be disposed in the at least partially processed space of the support member 110 to thereby be stably seated in the magnetic body 130. A core may be formed in a central hole of the coil 120 to provide a high-inductance coil component, and the core may be filled with a magnetic material, for example, the magnetic body 130.

The magnetic body 130, which forms an exterior of the coil component while filling an internal portion of the coil component, may fill peripheral spaces of the support member 110 and/or the coil 120. The magnetic body 130 may be formed of a magnetic material-resin composite in which a magnetic metal powder and a resin mixture are mixed with each other, and thus the support member 110 and the coil 120 may be embedded therein.

Referring to FIG. 11D, the support member 110, which is a base member for manufacturing of a coil component, may not remain inside the coil component 100-1 after the dicing.

The coil 120 may be a wound coil formed by a winding method. The lead terminals 121*a* and 121*b* of the coil 120 may be connected to the external electrodes 140, respectively.

The coil 120 may be disposed in the at least partially processed space of the support member 110 to thereby be stably seated in the magnetic body 130, but the support member 110 may not remain inside the coil component 100-1 due to the dicing. Similarly, a core may be formed in a central hole of the coil 120 to provide a high-inductance coil component, and the core may be filled with a magnetic material, for example, the magnetic body 130.

The magnetic body 130, which forms an exterior of the coil component while filling an internal portion of the coil component, may fill a peripheral space of the coil 120. Similarly, the magnetic body 130 may be formed of a magnetic material-resin composite in which a magnetic metal powder and a resin mixture are mixed with each other, and thus the coil 120 may be embedded therein.

FIGS. 12A through 12C are views detailing another example of the method of manufacturing a coil component.

Figure 12:
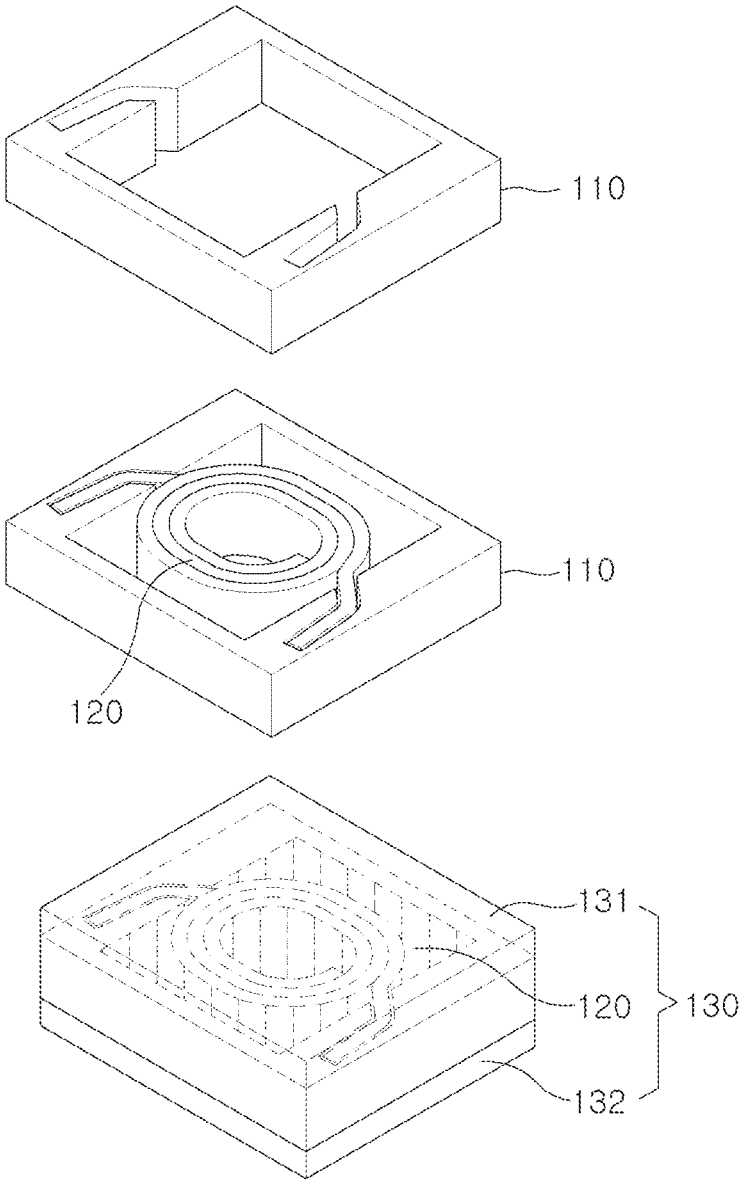
FIG. 12 is a view detailing another example of the method of manufacturing a coil component.

Manufacturing processes of the coil component illustrated in FIG. 12 is more simply illustrated as compared to the above-mentioned processes in FIGS. 10A through 10E. Here, an overlapping description will be omitted, and a main configuration will mainly be described.

First, a support member 110 may have an at least partially processed space 111. The at least partially processed space 111 of the support member may be a mounting space in which a coil 120 is disposed, and the coil 120 and the support member 110 may be formed to have a gap space therebetween.

The coil 120 may be seated in the at least partially processed space 111 of the support member 110 which is manufactured in advance. Here, the coil 120 may be a wound coil formed by a winding method. The at least partially processed space of the support member 110 may accommodate an entire body of the coil 120 and two lead terminals. Portions of the processed space accommodating two lead terminals therein may have a bent shape, which may allow for an increase in an area of the support member 110 by an area corresponding to the portions of the processed space accommodating two lead terminals, as compared to having a straight shape. The lead terminals of the coil 120 accommodated in the space as described above may be connected to external electrodes.

Meanwhile, in the seating of the coil 120, a fixation frame disposed on the coil 120 in at least one direction to fix a position of the coil 120 may be formed in the support member 110. The position of the coil 120 may be fixed by a fixation frame formed in the at least partially processed space 111 of the support member. The fixation frame may be formed of the same material as that of the support member 110 by processing.

In order to form a magnetic body 130 of the coil component, a magnetic material-resin composite may be added to peripheral spaces of the support member 110 and the coil 120 to embed the support member 110 and the coil 120, and then, the magnetic material-resin composite as described above may be compressed and cured. For instance, the magnetic body 130 may be formed by adding the magnetic material-resin composite in which the magnetic metal powder and the resin mixture are mixed with each other to the peripheral spaces of the support member 110 and the coil 120 to embed the support member 110 and the coil 120 therein.

Productivity may be improved, and molding cost may be reduced by using a magnetic sheet method to manufacture the coil component, as compared to an existing wound coil manufacturing method.

Figure 13A:
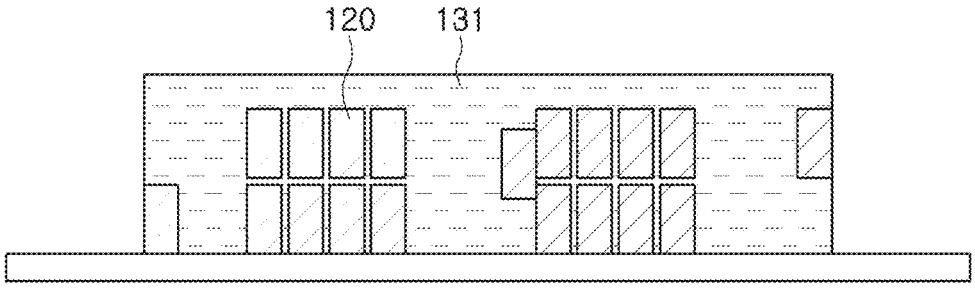
FIGS. 13A and 13B are views detailing compressing of magnetic sheets.
Figure 13B:
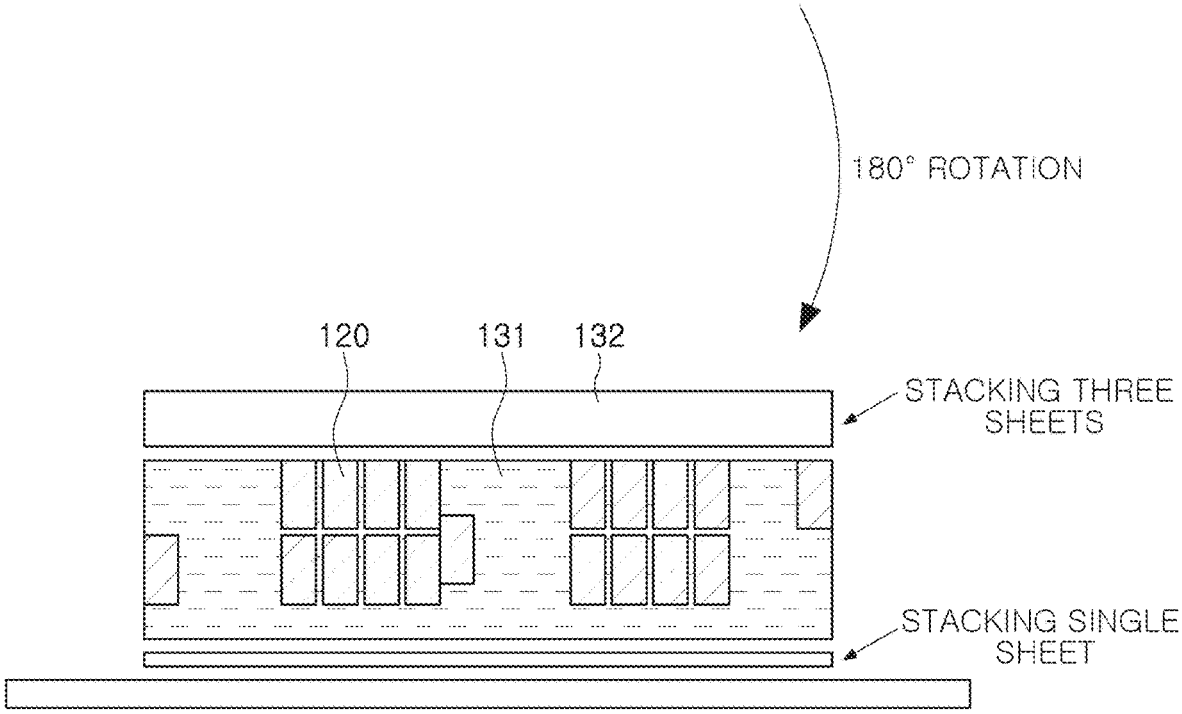

FIGS. 13A and 13B are views detailing the compressing of magnetic sheets.

Referring to FIG. 13A, a first magnetic sheet 131 may be stacked on one surfaces of the support member 110 and the coil 120, and then primarily compressed.

Referring to FIG. 13B, a second magnetic sheet 132 may be stacked on the support member 110 and the coil 120 in a direction in which the first magnetic sheet 131 is not formed thereon by turning over (rotating 180 degrees) the primarily compressed structure in a vertical direction, and then secondarily compressed. In this case, the coil 120 may be disposed in the center of the coil component by adjusting the number of sheets stacked on the second magnetic sheet 132 and the first magnetic sheet 131 to be compressed and cured thereon.

For example, one magnetic sheet may be stacked and three sheets of second magnetic sheet 132 may be stacked on the primarily compressed sheet, compressed, and then cured, as illustrated in FIGS. 13A and 13B. In this case, the magnetic sheets may be compressed under the same isostatic pressure condition. As a result, the coil 120 may be positioned in the center of the coil component in a thickness direction of the coil component. Thereafter, resin curing may be performed under vacuum pressurization conditions, thereby manufacturing a bar type coil component.

Figure 14:
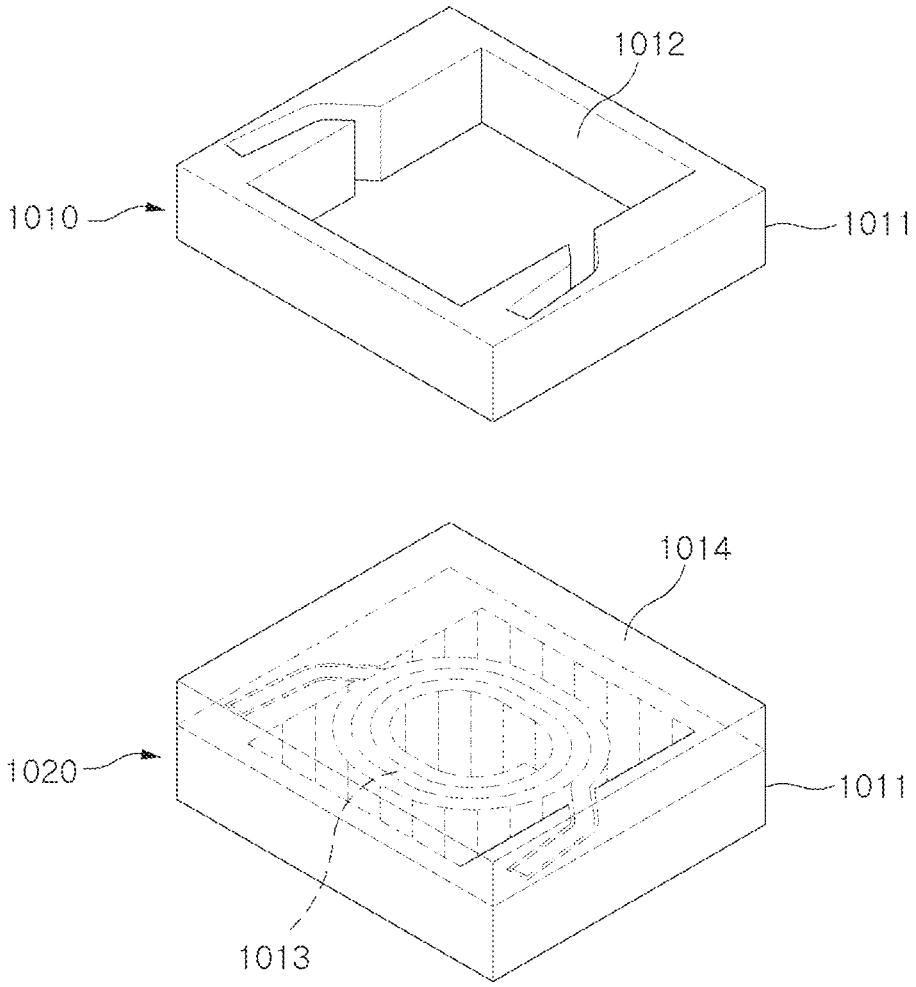
FIG. 14 is a view detailing another example of the method of manufacturing a coil component.

FIG. 14 is a view detailing another example of the method of manufacturing a coil component.

FIG. 14 illustrates a manufacturing process of a coil component in which an upper peripheral space of a coil is filled with a filler. Here, an overlapping description will be omitted, and a main configuration will mainly be described.

Referring to process 1010 in FIG. 14, at least a portion of a support member 1011 may be processed as a cavity 1012. This processing may be performed by a physical, optical, or chemical means. Further, a size and a shape of the cavity 1012 may be variously determined depending on requirements in a design or manufacturing process, and the cavity 1012 may be processed to have a larger length in a first direction than a width in a third direction. Referring to process 1020, a coil 1013 (for example, a wound coil) may be seated in the cavity 1012, and after the coil 1013 is seated, a peripheral space of the coil 1013 may be filled with the filler. In this case, the space may be filled by compressing one or more magnetic composite sheet as the filler. Thus, a magnetic body 1014 may be formed.

Figure 15:
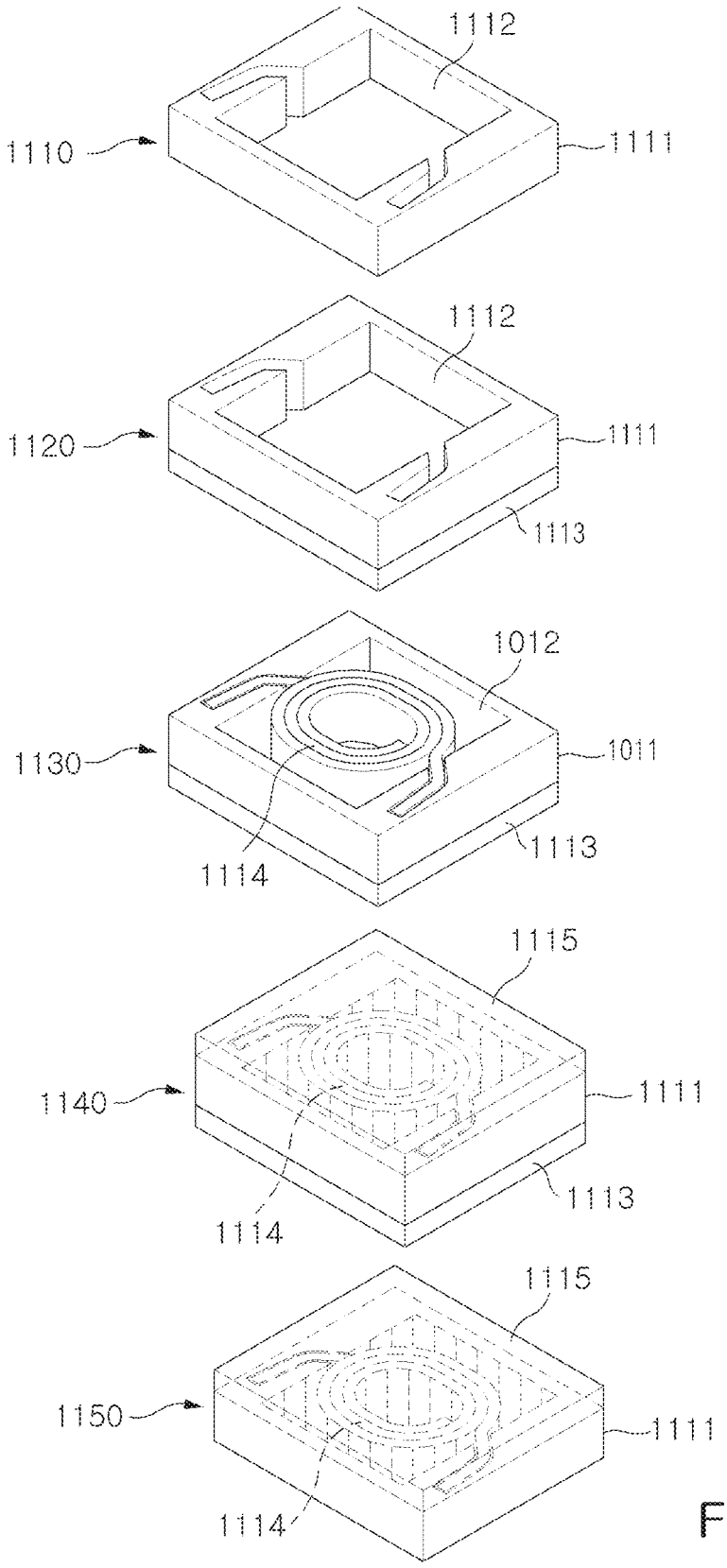
FIG. 15 is a view detailing another example of the method of manufacturing a coil component.

FIG. 15 is a view detailing another example of the method of manufacturing a coil component.

FIG. 15 illustrates a manufacturing process of a coil component in which an upper peripheral space of a coil is filled with a filler after a specific material is added below a support member. Here, an overlapping description will be omitted, and a main configuration will mainly be described.

Referring to process 1110, at least a portion of a support member 1111 may be processed as a cavity 1112. Referring to process 1120, the specific material 1113, such as an adhesive, an adhesive tape, and the like, may be added below the cavity 1112. Referring to process 1130, a coil 1114 (for example, a wound coil) may be seated in the cavity 1112, and after the coil 1114 is seated, a peripheral space of the coil 1114 may be filled with the filler in process 1140. Thus, a magnetic body 1115 may be formed. Referring to process 1150, the specific material added below the cavity 1112 may be removed.

Figure 16:
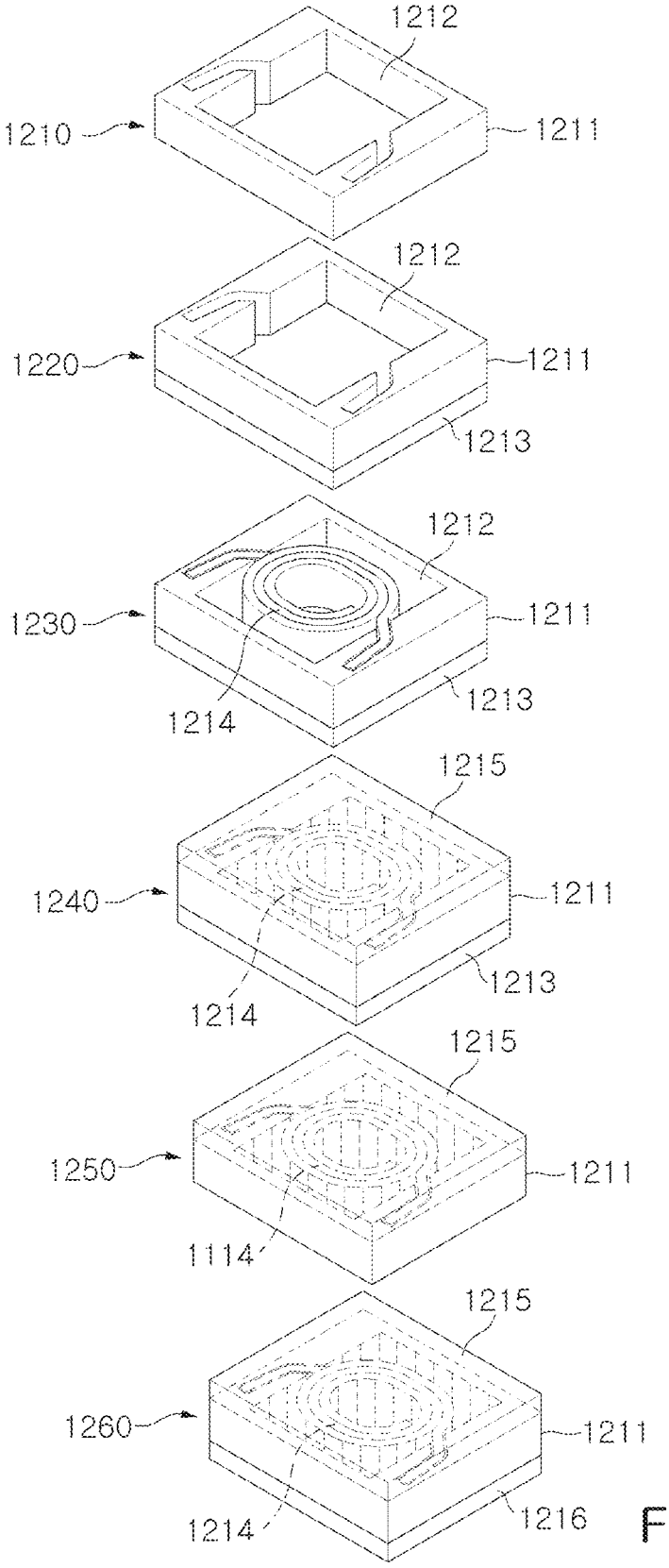
FIG. 16 is a view detailing another example of the method of manufacturing a coil component.

FIG. 16 is a view detailing another example of the method of manufacturing a coil component.

FIG. 16 illustrates a manufacturing process of a coil component in which upper and lower peripheral spaces of a coil are filled with a filler after a specific material is added below a support member. Here, an overlapping description will be omitted, and a main configuration will mainly be described.

Referring to process 1210, at least a portion of a support member 1211 may be processed as a cavity 1212. Referring to process 1220, a specific material 1213, such as an adhesive, an adhesive tape, and the like, may be added below the cavity 1212. Referring to process 1230, a coil 1214 (for example, a wound coil) may be seated in the cavity 1212, and after the coil 1214 is seated, the upper peripheral space of the coil 1214 may be filled with the filler in process 1240. Referring to process 1250, the specific material added below the cavity 1212 may be removed. Thus, a magnetic body 1215 may be formed. Referring to process 1260, the lower peripheral space of the coil 1214 may be filled with a filler 1216.

Figure 17:
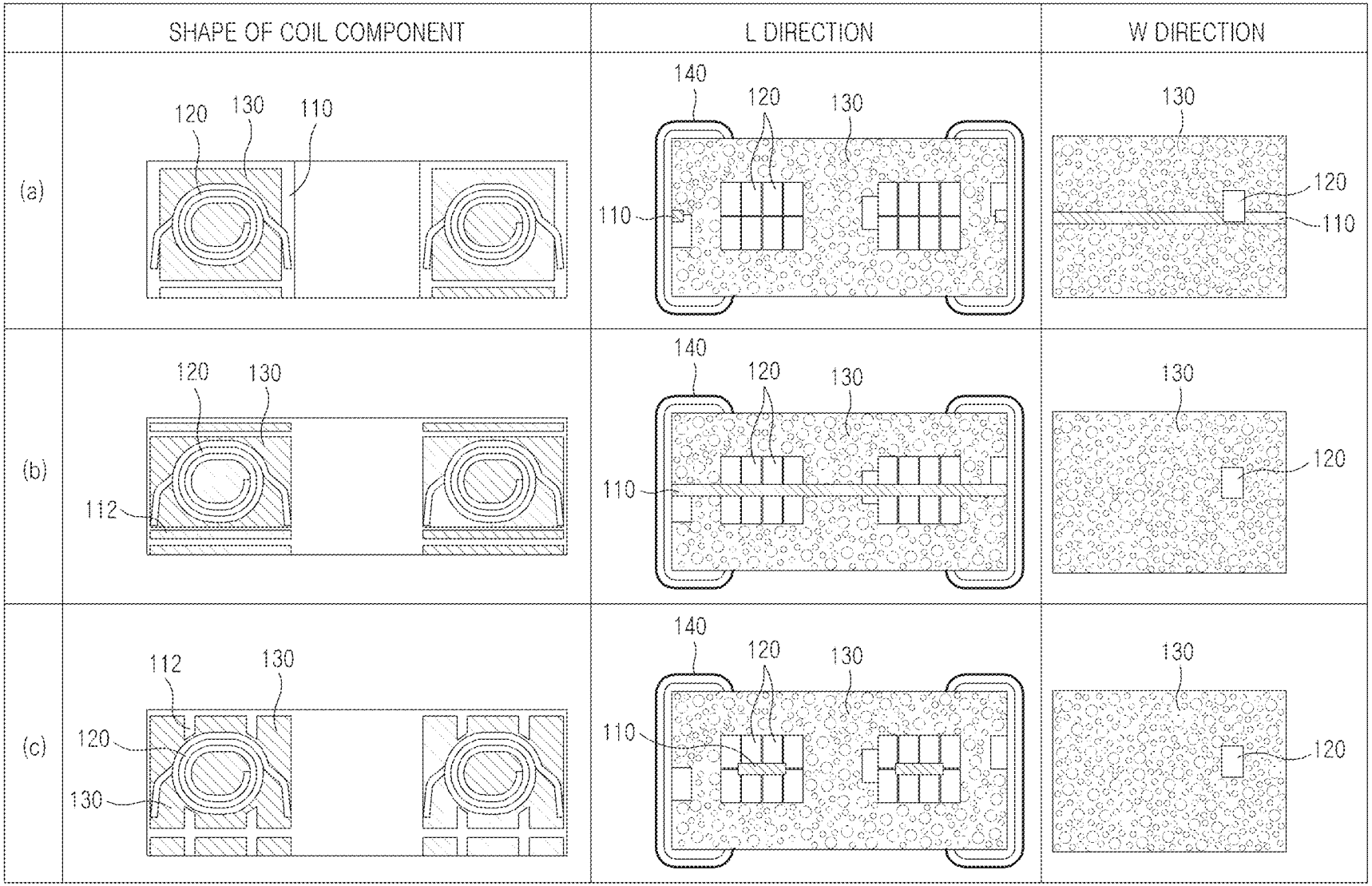
FIG. 17 is view detailing a fixation frame.

FIG. 17 is a view detailing a fixation frame.

Referring to FIG. 17, whether or not a fixation frame 112 is present, shapes of coil components depending on a shape of the fixation frame 112, and cross-sections obtained by respectively cutting the coil components in first (length) and third (width) directions may be compared. Here, the fixation frame 112, which is formed in the support member 110, may physically support a coil 120 to fix a position of the coil 120. A shape of an at least partially processed space formed in the support member 110 may also be changed depending on a shape of the fixation frame 112.

A coil component illustrated in Example (a) of FIG. 17 may not include the fixation frame 112 fixing the position of the coil 120. In this coil component, the coil 120 may be freely positioned in a mounting space, and thus a designer may position the coil 120 with relatively high precision in determining a position thereof. However, since size and form distributions of the coil 120 may be relatively increased, a failure rate of loading or inserting the coil 120 may be relatively high.

Coil components illustrated in Examples (b) and (c) of FIG. 17 may include the fixation frame 112 fixing the position of the coil 120. In these coil components, since size and form distributions of the coil 120 may be relatively decreased, a failure rate of loading or inserting the coil 120 may be relatively low.

Figure 18A:
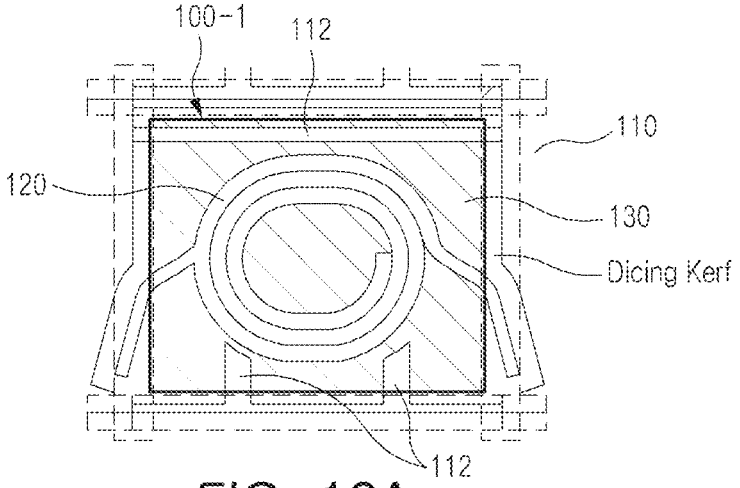
FIGS. 18A through 18C are views illustrating various examples of the fixation frame.
Figure 18B:
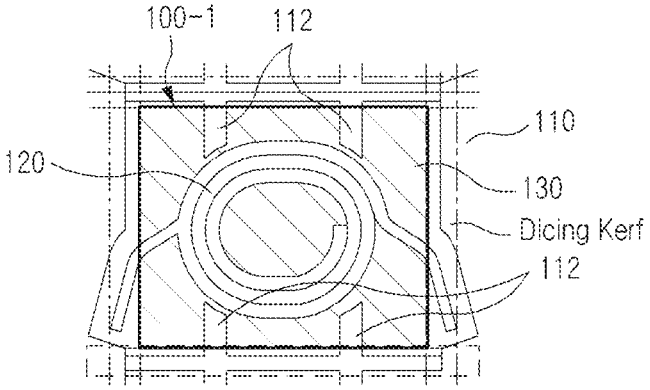
Figure 18C:
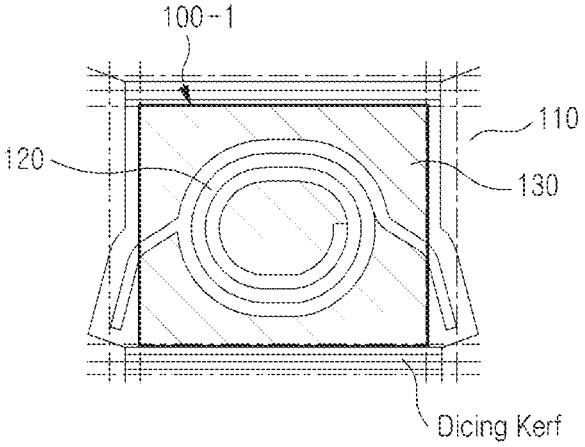

FIGS. 18A through 18C are views illustrating various examples of the fixation frame.

Referring to FIGS. 18A through 18C, a coil component may include a support member 110 in which an at least partially processed space 111 is formed, a coil 120 disposed in the processed space, and a magnetic body 130 in which the support member 110 and the coil 120 are embedded.

The at least partially processed space 111 may be formed in the support member 110, and thus the coil 120 may be disposed therein. In addition, a fixation frame 112 may be formed in an inner portion of the processed space to fix a position of the coil 120. The fixation frame 112 may be formed by processing the support member 110 and have various shapes. Examples of the fixation frame 112 will be described below.

Referring to FIG. 18A, the fixation frame 112 may be formed to stably mount the coil 120. For instance, the fixation frame 112 having a bar shape may be formed above the coil 120 and two fixation frames 112 having a protruding shape may be formed below the coil 120 to fix the position of the coil 120, based on the plan view of FIG. 18A. Here, a shape of the fixation frame 112 is not limited, but the fixation frames 112 may be formed to be spaced apart from the coil 120 by a predetermined distance, and distal ends thereof may be formed to be curved or inclined along the coil 120 to guide an oval shape of the coil 120.

Here, when the inserted support member 110 or the inserted fixation frame 112 of the support member 110 is designed to be smaller than a region thereof (for instance, a dicing kerf region) diced to thereby be removed by a dicing blade, or the like, the support member 110 or the fixation frame 112 of the support member 110 may not remain inside a manufactured coil component. However, when the support member 110 is designed to be significantly close to the coil 120, the support member 110 or the fixation frame 112 of the support member 110 may partially remain inside the coil 120 to improve position fixation precision of the coil component.

FIG. 18B illustrates another example of the fixation frame 112. In order to fix the position of the coil 120, two fixation frames 112 having a protruding rod shape may be formed above the coil 120, and two fixation frames 112 having a protruding rod shape may be formed below the coil 120, based on the plan view of FIG. 18B. Here, the fixation frames 112 may be formed to be spaced apart from the coil 120 by a predetermined distance, and distal ends thereof may be formed to be curved or inclined along the coil 120 to guide an oval shape of the coil 120.

Similarly, when the inserted support member 110 or the inserted fixation frame 112 of the support member 110 is designed to be smaller than a region thereof (for instance, a dicing kerf region) diced to thereby be removed by a dicing blade, or the like, the support member 110 or the fixation frame 112 of the support member 110 may not remain inside a manufactured coil component. However, when the support member 110 is significantly close to the coil 120, the support member 110 or the fixation frame 112 of the support member 110 may partially remain inside or outside of the coil 120 to improve position fixation precision of the coil component.

FIG. 18C illustrates an example of a coil component in which the fixation frame 112 is not separately formed.

Figure 19:
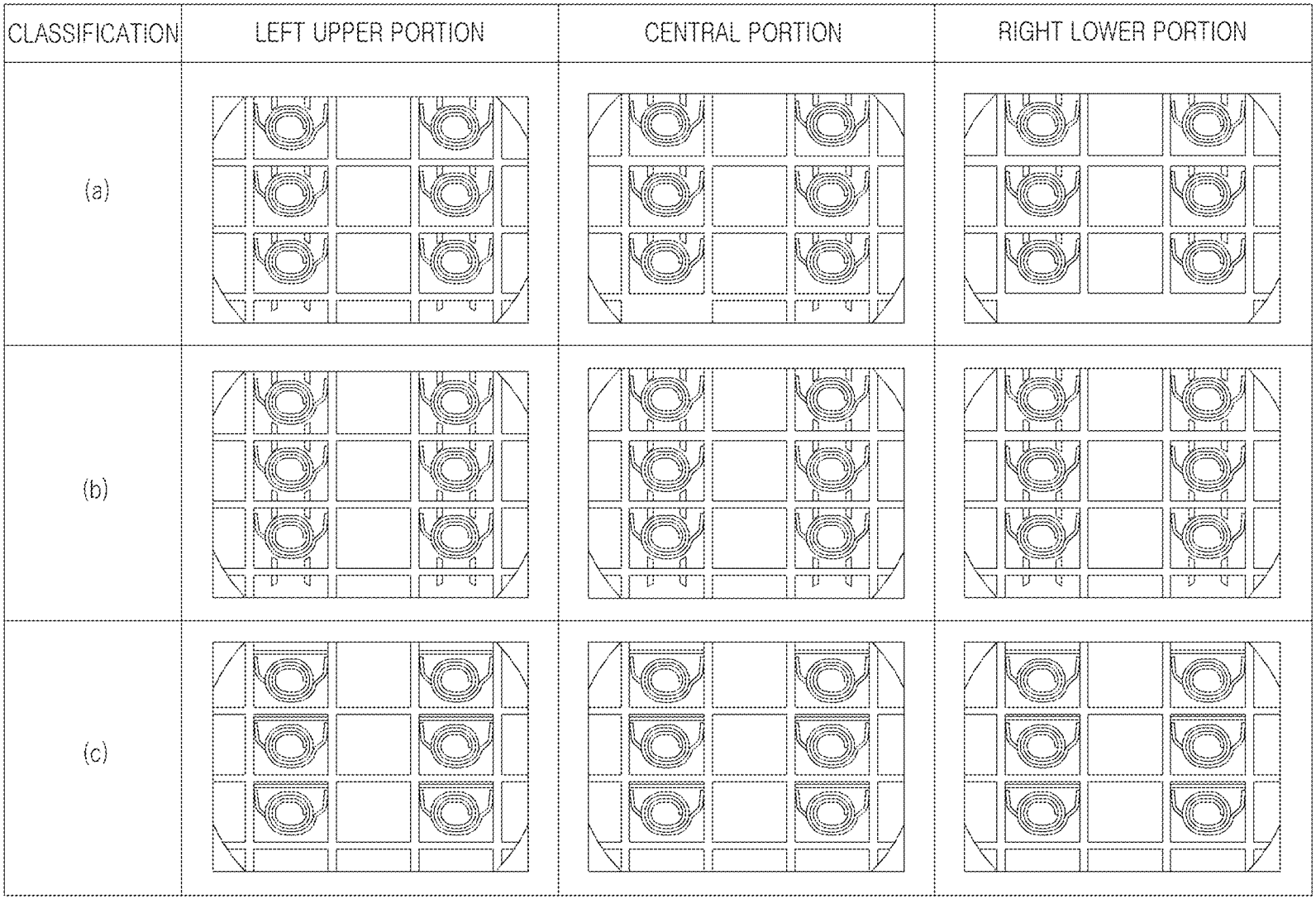
FIG. 19 is a view detailing misalignment of a coil after dicing.

FIG. 19 is a view detailing misalignment of a coil after dicing.

An individual coil component may be formed by compressing and curing magnetic sheets around a support member 110 and a coil 120 and then dicing a formed bulk structure. For instance, the bulk structure may be configured of a bar in which a plurality of coils 120 are regularly arranged and surroundings of the coil 120 are filled by magnetic sheets formed of a magnetic material-resin composite. The bulk structure as described above may be diced in length and width directions at a size of a designed coil component, and thus individual coil components may be manufactured by a dicing method. For example, the bulk structure may be diced in a form of an individual coil component using dicing equipment using a saw, and another dicing method such as a blade method, a laser method, or the like, may also be used. A misalignment phenomenon of the coil 120 disposed in the support member 110 may occur due to the dicing as described above. An example of the misalignment phenomenon will be described below.

In Example (a) of FIG. 19, an at least partially processed space of a support member 110 may include fixation frames 112 formed to protrude inwardly from the processed space. In other words, two fixation frames 112 may be disposed above the coil 120 to be spaced apart from each other by a predetermined distance, based on the plan view of FIG. 19A. In FIG. 19B, two fixation frames 112 formed to protrude may be disposed above and below the coil 120, respectively, to be spaced apart from each other by a predetermined distance, based on the plan view of Example (b) of FIG. 19. In Example (c) of FIG. 19, a fixation frame 112 may be disposed above the coil 120 in a bar shape in a horizontal direction, based on the plan view.

As a result of confirming position precision of the coil 120 in a magnetic material-resin composite using a non-destructive test (NDT) after dicing a bulk structure in a form of an individual coil component in respective cases, it may be confirmed that the coil 120 may be maintained in a suitable state without position misalignment of the coil 120, and since there is no coil 120 exposed to side surfaces of the coil component, individual coil components having excellent quality without exterior defects may be obtained.

Figure 20:
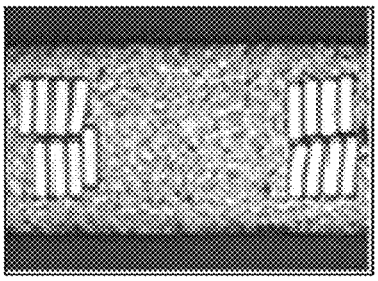
FIG. 20 is a view illustrating an internal structure of a coil component after dicing.
Figure 20:
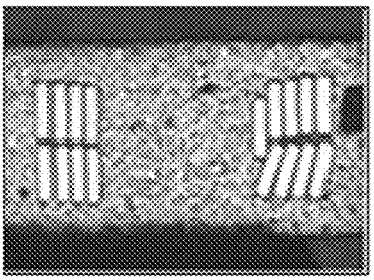
Figure 20:
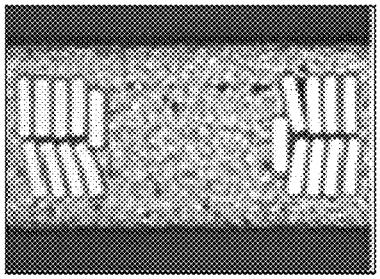
Figure 20:
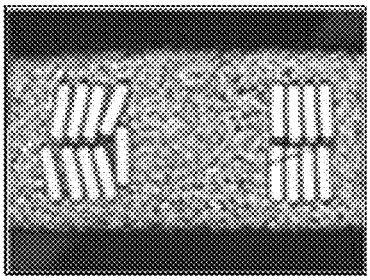
Figure 20:
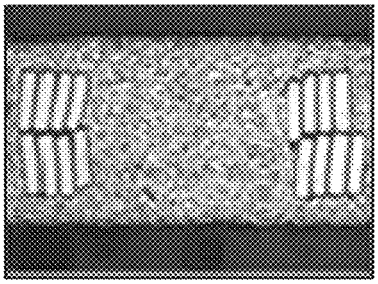
Figure 20:
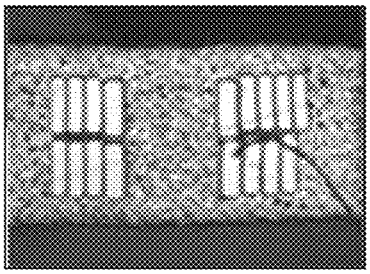

FIG. 20 is a view illustrating an internal structure of a coil component after dicing.

Figure 21:
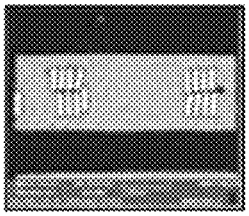
FIG. 21 is a view illustrating another internal structure of the coil component after dicing.
Figure 21:
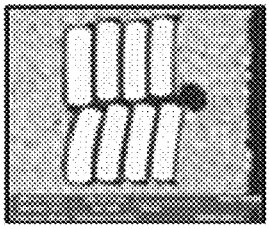
Figure 21:
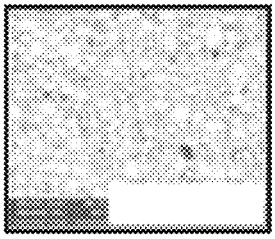
Figure 21:
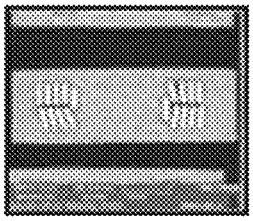
Figure 21:
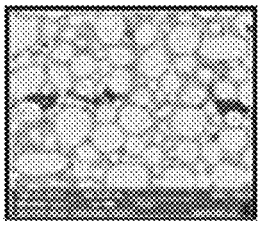
Figure 21:
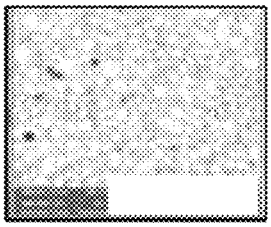
Figure 21:
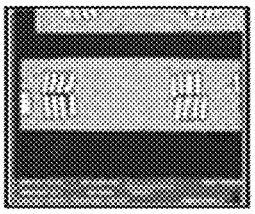
Figure 21:
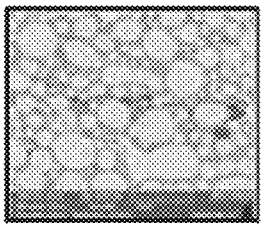
Figure 21:
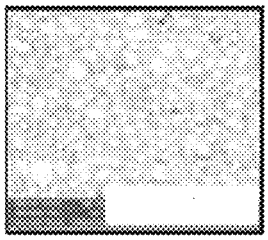

FIG. 21 is a view illustrating another internal structure of the coil component after dicing.

Figure 22:
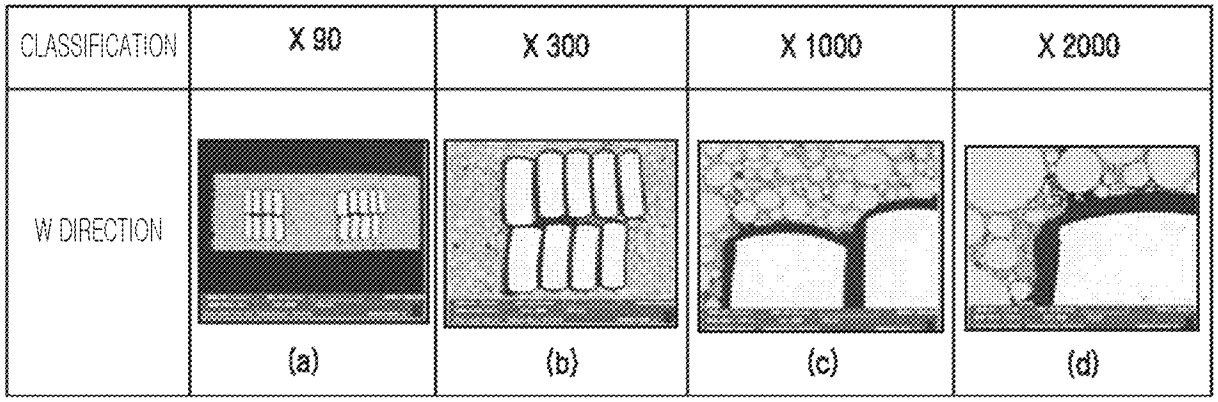
FIG. 22 is a view illustrating another internal structure of the coil component after dicing.

FIG. 22 is a view illustrating another internal structure of the coil component after dicing.

Example (a) of FIGS. 20 and Example (a) of 21 illustrate cross-sections of a coil component having the same structure as FIG. 18A in first (length) and third (width) directions. For instance, Example (a) of FIG. 20 and Example (a) of FIG. 21 illustrate the cross sections of the coil component in which a fixation frame 112 having a bar shape is formed on a coil 120 and two fixation frames 112 having a protruding shape are formed below the coil 120 to fix a position of the coil 120 in the first (length) and third (width) directions. Describing the cross section of the coil component of FIG. 21A in the third (width) direction, it may be confirmed that a fixation frame 112 having a bar shape is present in a right upper end of the coil.

Example (b) of FIG. 20 and Example (b) of FIG. 21 illustrate cross-sections of a coil component having the same structure as FIG. 18B in first (length) and third (width) directions. Example (b) of FIG. 20 and Example (b) of FIG. 21 illustrate the cross sections of the coil component in which two fixation frames 112 having a protruding shape are formed on a coil 120 and two fixation frames 112 having a protruding shape are also formed below the coil 120 to fix a position of the coil 120 in the first (length) and third (width) directions.

Example (c) of FIG. 20 and Example (c) of FIG. 21 illustrate cross-sections of a coil component having the same structure as FIG. 18C in first (length) and third (width) directions. Example (c) of FIG. 20 and Example (c) of FIG. 21 illustrate cross-sections of a coil component in which a separate fixation frame 112 is not formed in the first (length) and third (width) direction.

FIG. 22 is an enlarged view of a cross section of a coil component having the same structure as Example (c) of FIG. 20 and Example (c) of FIG. 21 in a third (width) direction.

Referring to Examples (a) through (d) of FIG. 22, an individual coil component may be manufactured by compressing and curing magnetic sheets around a support member 110 and a coil 120 and dicing the formed structure as described above, and deformation of the coil 120 after the dicing depending on a shape of the coil component may be confirmed through an example of a structure of the coil component.

As a result, there is almost no deformation of the coil 120 due to compression pressure, and a phenomenon in which a magnetic metal penetrates through an insulation layer insulating the coil 120 to deteriorate insulation resistance does not occur. In addition, cracks, or the like, affecting strength of a magnetic body 130, solder heat resistance characteristics, or the like, caused by a reaction with a resin based material of an internal magnetic body 130 may not be found therein.

In addition, the coil component may also have a high metal filling rate affecting inductance, and insulation breakdown does not occur, and thus, withstand voltage characteristics, for example, breakdown voltage (BDV) characteristics may be improved.

Figure 23A:
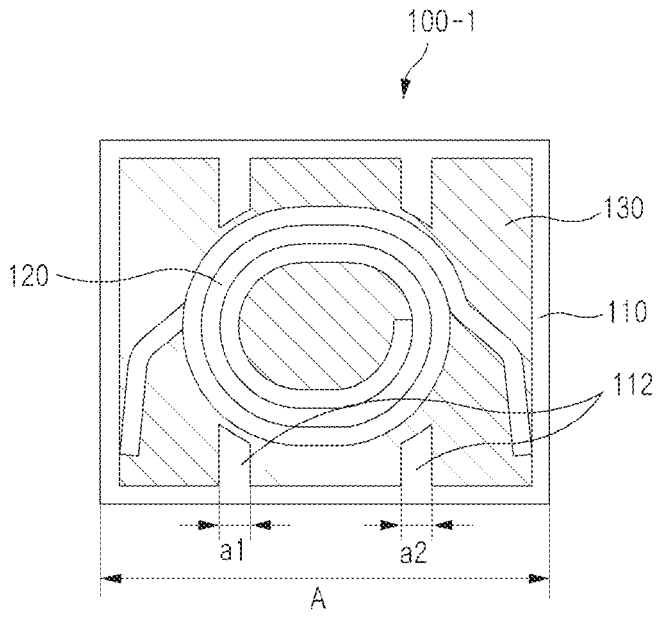
FIGS. 23A and 23B are views detailing a size of the fixation frame.
Figure 23B:
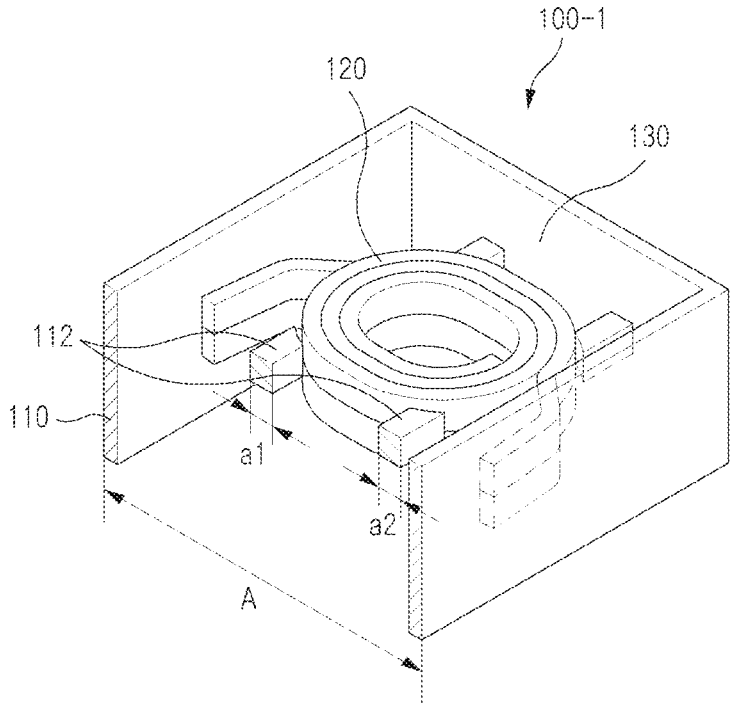

FIGS. 23A and 23B are views detailing a size of the fixation frame.

FIG. 23A is a view illustrating a schematic structure of a coil component, and FIG. 23B is a partially cut-away perspective view of a coil component after processing.

Referring to FIGS. 23A and 23B, an at least partially processed space 111 of a support member 110 may have fixation frames 112 having a significantly reduced size to prevent a processing portion from being unnecessarily increased due to fixation of a coil 120 or prevent inductance from being decreased. To this end, a ratio with respect to the fixation frame 112 may be represented by the following Equation (1).

$$0.01<(a1+a2+\ldots+an)/A<0.6 \qquad \text{Equation (1):}$$

Here, a1, a2, . . . , and an refer to a length of each of the fixation frames in a first (length) direction, and A refers to a length of the coil component in the first (length) direction. When (a1+a2+ . . . + an)/A of Equation (1) is 0.01 or less, a position of the coil 120 may be unstable, and when (a1+a2+ . . . + an)/A is 0.6 or more, inductance may be decreased. In this case, the fixation frame 112 may have various shapes such as a circular shape, a quadrangular shape, or the like. For example, when a length ratio of the fixation frames 112 in the first (length) direction is set, a relatively high rated current, low DC resistance, and high-precision mounting may be implemented. According to a design, the ratio may be more than 0.01 but less than 0.6.

Figure 24A:
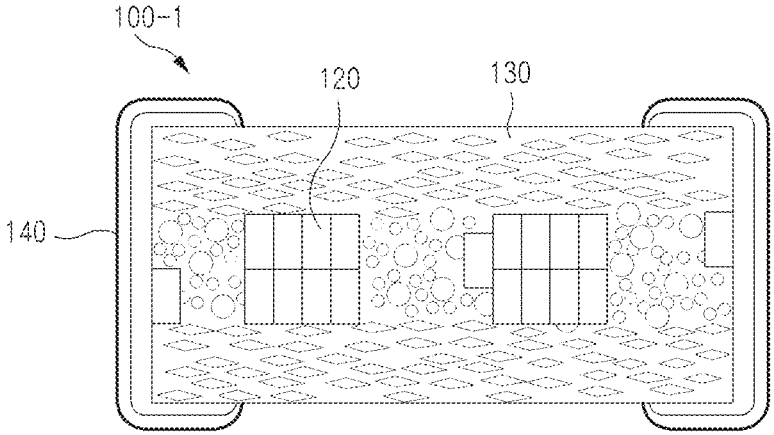
FIGS. 24A through 24C are schematic views illustrating an example of a magnetic body.
Figure 24B:
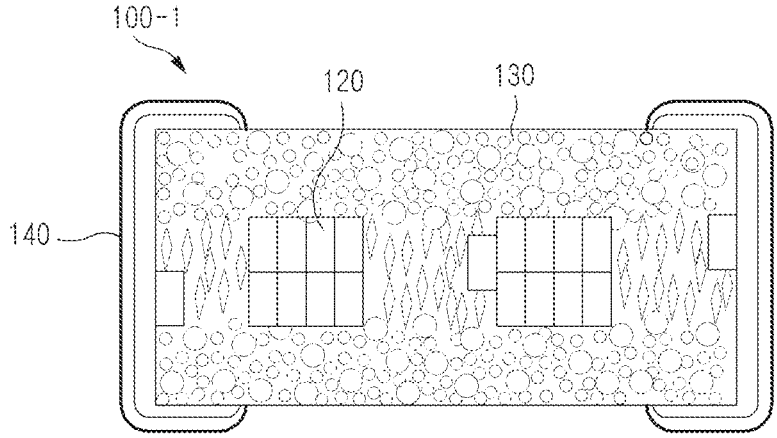
Figure 24C:
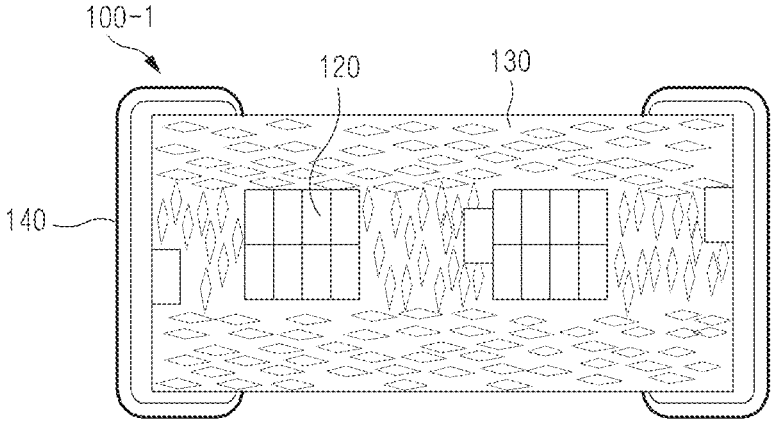

FIGS. 24A through 24C are schematic views illustrating an example of a magnetic body.

Referring to FIGS. 24A through 24C, heterogeneous sheets may be applied to a magnetic body 130, and a support member 110 and a coil 120 may be embedded in the magnetic body 130.

FIG. 24A illustrates a magnetic body in which needle-shaped powder particles are inserted into external cover sheets, and in an internal portion of the magnetic body in which the coil 120 is disposed, fine and coarse powder particles are mixed, and the needle-shaped powder may be arranged in a horizontal direction.

FIG. 24B illustrates a magnetic body in which needle-shaped powder particles are inserted into a portion thereof in which the coil 120 is disposed, and the needle-shaped powder may be arranged in a vertical direction in an internal portion of the magnetic body in which the coil 120 is disposed, and fine and coarse powder particles may be mixed in cover sheets.

FIG. 24C illustrates a magnetic body in which needle-shaped powder particles are inserted fully therein, and the needle-shaped powder may be arranged in a vertical direction in an internal portion of the magnetic body in which the coil 120 is disposed, and the needle-shaped powder may be arranged in a horizontal direction in cover sheets.

Efficiency of a magnetic field may be significantly increased within a limited size by adjusting a ratio of the needle-shaped powder particles as described above.

Figure 25:
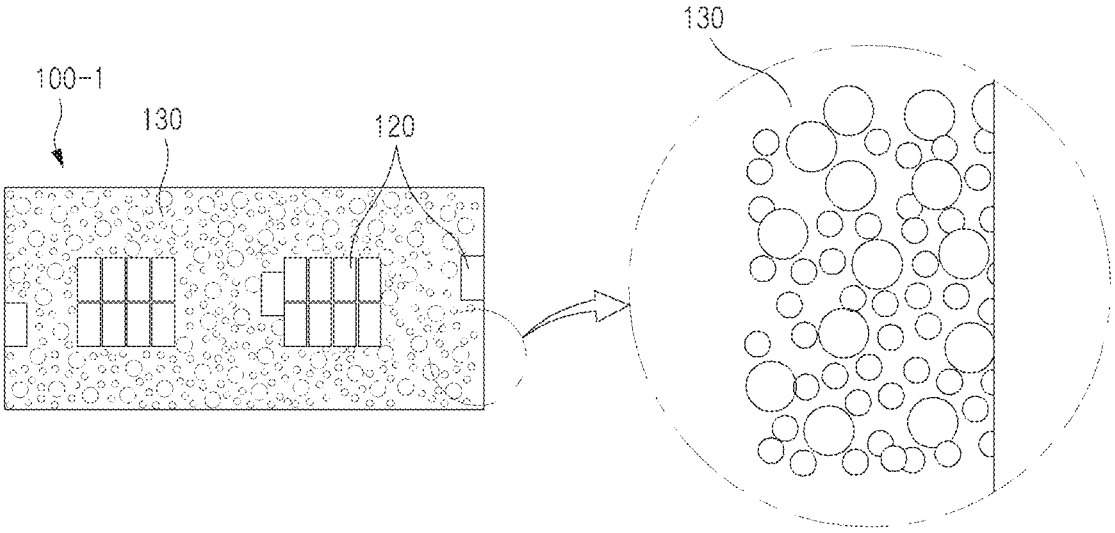
FIG. 25 is a schematic view illustrating an example of a diced surface of the magnetic body.

FIG. 25 is a schematic view illustrating an example of a diced surface of the magnetic body.

After the dicing is performed, a metal containing Fe as a main ingredient may be used as the magnetic metal powder of the magnetic material-resin composite, a material of the magnetic body 130. When plating is performed after forming external electrodes, plating spread may occur.

In this case, current crowding may be prevented when a plating current is applied by significantly decreasing irregularities of a surface of the magnetic body 130 to prevent plating spread. For instance, in the magnetic body 130, the magnetic metal powder may have a hemispherical shape of which a diced and exposed surface is planarized or may have a shape in which a sphere thereof is partially diced, and thus, the magnetic body 130 may be implemented to have a flat surface as illustrated in FIG. 25. Thus, when the plating current is applied, current crowding may be prevented.

Further, in order to prevent plating spread, an insulation layer may be applied onto surfaces of the magnetic body 130 (portions except for portions thereof corresponding to external electrodes). The insulation layer may be formed using at least one of a glass-based material containing Si, an insulation resin, and plasma. The glass-based material containing Si or the insulation resin may be applied by a printing and dipping method, or plasma treatment of an insulation material may be performed. In detail, plating spread may be prevented by applying and curing an insulation polymer onto side surfaces and upper and lower surfaces of the magnetic body 130.

As set forth above, according to exemplary embodiments in the present disclosure, the coil component assembly allowing for stable mounting of the coil, having excellent productivity, and exhibiting decreased molding costs, the coil component, and the method of efficiently manufacturing a coil component may be provided.

While exemplary embodiments have been shown and described above, it will be apparent to those skilled in the art that modifications and variations could be made without departing from the scope of the present invention as defined by the appended claims.

What is claimed is:

1. A coil component, comprising:

a coil having a lead-out terminal;

a body embedding the coil and having a flat end surface; and an external electrode disposed on the flat end surface of the body, and connected to the lead-out terminal, wherein the lead-out terminal has a tapered end portion including a first flat surface flush with the flat end surface of the body, the tapered end portion includes a second surface embedded in the body and inclined with respect to the flat end surface, the body includes a magnetic metal powder and resin mixture, and the flat end surface of the body is provided with the resin mixture, and a magnetic metal particle of the magnetic metal powder includes a round surface, and a flat surface intersecting the round surface and exposed from the flat end surface of the body.

2. The coil component of claim 1, wherein the magnetic metal particle has a hemispherical shape or is a portion of a spherical shape.

3. The coil component of claim 1, wherein the magnetic metal powder includes a plurality of magnetic metal powders whose particle sizes are different.

4. The coil component of claim 1, wherein the first flat surface and the second surface of the tapered end portion have an acute angle therebetween.

5. The coil component of claim 1, wherein an axial direction of the coil is a height direction and a direction perpendicular to the axial direction is a width direction, the first flat surface of the tapered end portion has a rectangular shape in which an aspect ratio of height to width is 1 or more.

6. The coil component of claim 1, further comprising:

a line plating layer formed on the first flat surface of the tapered end portion, wherein the lead-out terminal is connected to the external electrode through the line plating layer.

7. The coil component of claim 6, wherein the line plating layer includes copper (Cu), and the external electrode includes at least one of nickel (Ni) or tin (Sn) disposed on the line plating layer.

8. The coil component of claim 1, further comprising:

an insulating layer disposed in a surface of the body.

9. The coil component of claim 8, wherein the insulating layer includes at least one of a glass-based material containing silicon (Si), an insulating resin, and a plasma.

10. The coil component of claim 1, wherein at least one gap is present in the body, and the gap is formed in a core region of at least the coil.

11. The coil component of claim 10, wherein the body is provided by stacking a plurality of magnetic resin compounds including the magnetic metal powder and the resin mixture in the form of a sheet, and the gap is present between the plurality of magnetic resin compounds.

12. The coil component of claim 1, wherein the coil component is a power inductor.

13. The coil component of claim 6, wherein the line plating layer includes copper (Cu), and the external electrode includes at least one of silver (Ag) or Cu disposed on the line plating layer and at least one of Ni or Sn disposed on the at least one of silver (Ag) or Cu.

14. The coil component of claim 1, wherein the coil is a winding type coil.

15. A coil component, comprising:

a winding type coil having at least one lead-out terminal;

a body covering the coil, and including a magnetic metal powder and resin mixture; and an external electrode disposed on the body, and connected to the lead-out terminal, wherein a side surface of the body is provided with the resin mixture, a magnetic metal particle of the magnetic metal powder includes a round surface, and a flat surface intersecting the round surface and exposed from the side surface of the body, and the side surface of the body includes a plurality of recesses having a shape corresponding to that of the magnetic metal particle.

16. The coil component of claim 15, wherein the plurality of recesses are randomly distributed on the side surface of the body.

17. A coil component, comprising:

a coil having a lead-out terminal;

a support member made of a first material, and having a groove in which the lead-out terminal is disposed;

a body made of a second material different from the first material, and embedding the coil; and an external electrode disposed on the body, and connected to the lead-out terminal, wherein the support member and the lead-out terminal are exposed from a surface of the body which intersects the groove of the support member, the second material fills at least a portion of the groove, the external electrode is in direct contact with the support member and the second material filling at least the portion of the groove, the second material includes a magnetic metal powder and resin mixture, the surface of the body is provided with the resin mixture, a magnetic metal particle of the magnetic metal powder includes a round surface, and a flat surface intersecting the round surface and exposed from the surface of the body, and the surface of the body includes a plurality of recesses having a shape corresponding to that of the magnetic metal particle.

18. The coil component of claim 17, further comprising:

a plurality of fixation members made of the first material and spaced apart from each other, wherein the plurality of fixation members are exposed from the body.

19. The coil component of claim 17, wherein the coil is a winding type coil.

* * * * *